US010920438B2

(12) United States Patent
Aloi

(10) Patent No.: US 10,920,438 B2
(45) Date of Patent: Feb. 16, 2021

(54) POOL COVER SYSTEMS AND METHODS

(71) Applicant: ALOI GROUP PTY LTD, Melbourne (AU)

(72) Inventor: Nicholas Aloi, Perth (AU)

(73) Assignee: ALOI GROUP PTY LTD, Melbourne (AU)

( * ) Notice: Subject to any disclaimer, the term of this patent is extended or adjusted under 35 U.S.C. 154(b) by 29 days.

(21) Appl. No.: 16/076,568

(22) PCT Filed: Feb. 8, 2017

(86) PCT No.: PCT/AU2017/050101
§ 371 (c)(1),
(2) Date: Aug. 8, 2018

(87) PCT Pub. No.: WO2017/136882
PCT Pub. Date: Aug. 17, 2017

(65) Prior Publication Data

US 2019/0063094 A1 Feb. 28, 2019

(30) Foreign Application Priority Data

Feb. 8, 2016 (AU) ..... 2016900413
Oct. 7, 2016 (AU) ..... 2016904084

(51) Int. Cl.
*E04H 4/10* (2006.01)

(52) U.S. Cl.
CPC ..... *E04H 4/103* (2013.01); *E04H 4/10* (2013.01)

(58) Field of Classification Search
CPC ..... E04H 4/10; E04H 4/103; E04H 4/105; E04H 4/106
See application file for complete search history.

(56) References Cited

U.S. PATENT DOCUMENTS 3,533,110 A * 10/1970 Gisondi ..... E04H 4/103 4/499
4,028,750 A * 6/1977 Gustafsson ..... E04H 4/10 4/498

(Continued)

FOREIGN PATENT DOCUMENTS

AU 2002248975 B2 11/2002
DE 2536548 A1 2/1977

(Continued)

OTHER PUBLICATIONS

International Search Report and Written Opinion for International Patent Application No. PCT/AU2017/050101, dated May 25, 2017, 12 pages.

(Continued)

*Primary Examiner* — J C Jacyna

(74) *Attorney, Agent, or Firm* — Withrow & Terranova, P.L.L.C.; Vincent K. Gustafson

(57) ABSTRACT

In one preferred form there is provide a pool cover arrangement (10) comprising: a body (12) having a first set of cells (24) and a second set of cells (26). The first set of cells (24) provide a first area (35) for floating on water. The first area (35) comprises the forward facing areas (27) of the first set of cells (24). The second set of cells (26) are spaced away from the forward facing areas (27), so as to sit above the water, when the first set of cells (24) sit on the water. In other preferred forms ventilation holes and layers are provided.

19 Claims, 23 Drawing Sheets

(56) References Cited

U.S. PATENT DOCUMENTS

| | | | | |
|---|---|---|---|---|
| 5,511,536 | A | 4/1996 | Bussey, Jr. et al. | |
| 6,519,788 | B1 | 2/2003 | Epple | |
| 6,571,789 | B1 * | 6/2003 | Mora | E04H 4/106 126/565 |
| 6,915,534 | B1 | 7/2005 | Johannes | |
| 8,201,285 | B1 * | 6/2012 | Pugliese | E04H 4/103 4/498 |

FOREIGN PATENT DOCUMENTS

| | | | |
|---|---|---|---|
| EP | 0453748 | A1 | 10/1991 |
| FR | 2684125 | A1 | 5/1993 |
| WO | 02086258 | A1 | 10/2002 |

OTHER PUBLICATIONS

International Preliminary Report on Patentability for International Patent Application No. PCT/AU2017/050101, dated Aug. 23, 2018,, 8 pages.

* cited by examiner

Fig. 18a
Fig. 18b
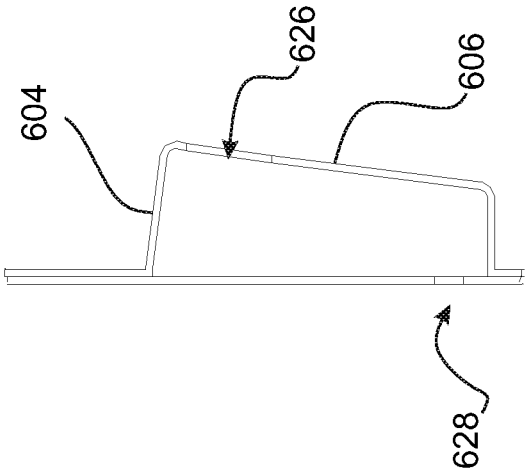
Fig. 18c
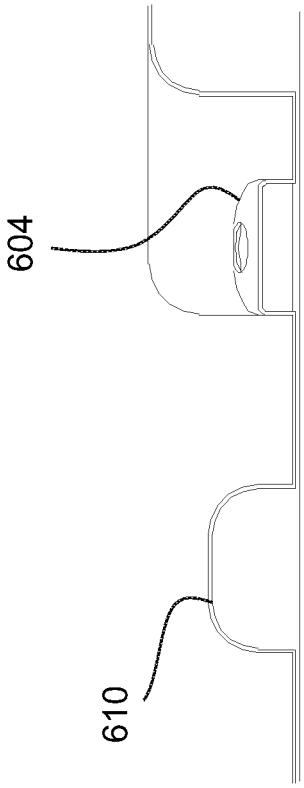
Fig. 18d
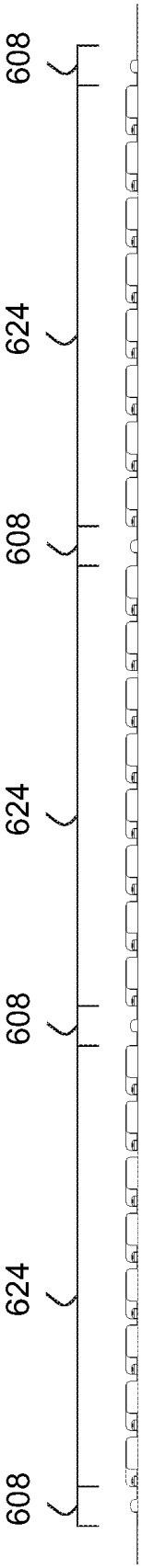

POOL COVER SYSTEMS AND METHODS

STATEMENT OF RELATED APPLICATIONS

This application is a U.S.C. § 371 national phase filing of International Patent Application No. PCT/AU2017/050101 filed on Feb. 8, 2017, and claims priority from Australian Provisional Patent Application No. 2016900413 filed Feb. 8, 2016; and (ii) Australian Provisional Patent Application No. 2016904084 filed Oct. 7, 2016 of the same title. The entire contents of the foregoing International and Australian patent applications are hereby incorporated by reference herein.

BACKGROUND OF THE INVENTION

In the domestic pool cover market, pool covers are manufactured in various forms. Generally, pool covers are used for the purpose of limiting evaporation. Pool covers are also used to reflect sunlight and/or prevent heat loss to manipulate pool temperature.

Problems associated with pool covers include unaccounted for chlorine build-up that results in inner pool surface deterioration. Chlorine build up can also result in damage to pool apparatus such as pool cleaners.

The inventor has developed the present invention against this background and the problems and difficulties associated therewith.

SUMMARY

According to an aspect of preferred embodiments herein described there is provided a pool cover arrangement comprising: a body having a first set of cells and a second set of cells; the second set of cells including faces configured to at least partially sit above the surface of the water Preferably each of the cells in the first set of cells is a closed air-cell; and each of the cells in the second set of the cells is an open air-cell that provides a ventilation passage having an inlet and an outlet for allowing chlorine gas to vent from the water Preferably each inlet has an opening area at least half the size of the opening area of the corresponding outlet.

Preferably the inlet and the outlet of each ventilation passage are offset with respect to vertical, when the body is positioned on the water, the inlet and the outlets being offset to limit direct water exposure to sunlight during the middle of the day.

Preferably the cells of the second set of cells each have a downwardly directed lower wall for directing water downwardly through the ventilation passage to limit the likelihood of water accumulation within the ventilation passage.

Preferably the second set of cells comprise elongate cells, each having an respective inlet and outlet at opposite ends of the cell, the second set of cells being arranged at 90 degrees to the first set of the cells.

Preferably the inlets are disposed below the outlets, above the water level, when the body is positioned on the water, with each inlet being offset from a respective outlet by at least 3 mm, in a direction in the horizontal plane.

Preferably the first set of cells provide a first area for floating on water; and the second set of cells is spaced away from the first area to allow the second set of cells to sit above the water, when the first set of cells sits on the water.

Preferably the second set of cells are spaced a distance of at least 1.5 mm from the surface of the body of water, when the body of the pool cover arrangement is positioned on the water.

Preferably the second set of cells are spaced a distance of at least 3 mm from the surface of the body of water, when the body of the pool cover arrangement is positioned on the water.

Preferably the second set of cells are of a reduced depth, relative to the first set of cells; the depth of each of the second set of cells being 3 to 4 mm; and the depth of each of the first set of cells being 6 to 8 mm.

Preferably the second set of cells are of a reduced depth, relative to the first set of cells; the depth of each of the second set of cells being at least 1.5 mm; and the depth of each of the first set of cells being at least 3 mm.

Preferably the cells of the second set of cells are repetitively positioned between the cells of the first set of cells according to a repeating pattern to relatively consistently distribute the second set of cells over the body of the pool cover arrangement.

Preferably the first set of cells and the second set of cells are each formed from at least two of the same layers of plastics material.

Preferably an intermediate layer is provided to preferentially allow the ventilation of chlorine gas.

Preferably the body provides a planar sheet from which at least one other sheet is fixed to provide the cells.

According to an aspect of preferred embodiments herein described there is provided a pool cover arrangement comprising: a body able to be positioned on the surface of a body of water; a number of cells provided by the body of the pool cover arrangement; and a number of ventilation passages extending through the body of the pool cover arrangement; wherein the cells comprise a first set of cells and a second set of cells; the first set of cells for providing heat insulation; the first set of cells being provided for contacting the water; the second set of cells being inset relative to the first set of cells with the second set of cells inset to expose an increased water surface area from which chlorine gas is able to vent through the ventilation passages, when the body of the pool cover arrangement is positioned on the water.

According to an aspect of preferred embodiments herein described there is provided a pool cover comprising: a body able to be positioned on the surface of a body of water; a number of cells provided by the body of the pool cover arrangement; and a number of ventilation passages extending through the body of the pool cover arrangement; wherein the cells comprise a first set of cells and a second set of cells; the first set of cells for providing heat insulation; the first set of cells being provided for contacting the water; the second set of cells being inset relative to the first set of cells with the second set of cells inset to expose an increased water surface area from which chlorine gas is able to vent through the ventilation passages, when the body of the pool cover arrangement is positioned on the water.

According to an aspect of preferred embodiments herein described there is provided a pool cover arrangement comprising: a body able to be positioned on the surface of a body of water; a number of cells provided by the body of the pool cover arrangement; and a number of ventilation passages extending through the body of the pool cover arrangement; wherein each ventilation passage has an inlet and an outlet for allowing chlorine gas to vent from the water; the inlet and the outlet of each ventilation passage being offset with respect to vertical, when the body is positioned on the water, the inlet and the outlets being offset to limit direct water exposure to sunlight during the middle of the day.

Preferably the inlets are disposed below the outlets, above the water level, when the body is positioned on the water, with the inlets being offset by at least 3 mm, in a direction in the horizontal plane.

According to an aspect of preferred embodiments herein described there is provided a pool cover comprising: a body able to be positioned on the surface of a body of water; a number of cells provided by the body of the pool cover arrangement; and a number of ventilation passages extending through the body of the pool cover arrangement; wherein each ventilation passage has an inlet and an outlet for allowing chlorine gas to vent from the water; the inlet and the outlet of each ventilation passage being offset with respect to vertical, when the body is positioned on the water, the inlet and the outlets being offset to limit direct water exposure to sunlight during the middle of the day.

According to an aspect of preferred embodiments herein described there is provided a method of forming a pool cover arrangement including: using pins to create ventilation passages in a pool cover arrangement by pressing the pins into an upper layer and a lower layer of the pool cover arrangement.

Preferably the method includes heating the pins to a temperature sufficient to heat the upper and lower layers at the points at which the pins are inserted through the upper and lower layers of the pool cover arrangement.

Preferably the temperature of the pins is maintained between 50 to 100 degrees Celsius.

Preferably the method includes concurrently pressing the pins into an upper layer and the lower layer of a pool cover arrangement, using a press, removing the pins and subsequently moving the pool cover arrangement to another position to repeat the operations.

Preferably the method includes positioning location elements of the pool cover arrangement in location elements provided by a press and moving the location elements of the press to move the pool cover arrangement after a pressing operation.

Preferably the method includes providing the location elements of the press in the form of at least one continuous looping track that is mechanically moved to position the pool cover arrangement.

Preferably the method includes using a plurality of continuous looping tracks having the pins therebetween, the looping tracks maintaining the position of the pins relative to the pool cover arrangement.

Preferably the location elements of the press comprise depressions and the location elements of the pool cover arrangement comprise cells of the pool cover arrangement.

Preferably the method includes rolling the pool cover arrangement from one spool to another spool with the press therebetween.

According to a seventh aspect of preferred embodiments herein described there is provided a pool cover arrangement comprising: a body having a first set of cells for providing heat insulation; and at least two runs of location cells each arranged in series along the length of the body; the runs comprising lengths for being received in tracks of a press.

Preferably there are four lengths of location cells, two lengths on the side portions of the pool cover arrangement and two lengths spaced therebetween.

According to an aspect of preferred embodiments herein described there is provided a pool cover press arrangement for use in manufacturing pool covers; the press including two opposite press sections each having pins; the press sections for receiving a pool cover arrangement therebetween; and an actuator for moving the pins into the pool cover arrangement to form openings in cells of the pool cover arrangement.

Preferably the pool cover press arrangement includes a heating element for heating the pins.

Preferably each press section includes groups of pins separated by track arrangements for receiving lengths containing location elements provided by the pool cover arrangements; the track arrangements including location elements for receiving the location elements of the pool cover arrangement for holding the pool cover arrangement in position for pressing and subsequently moving the pool cover arrangement.

According to an aspect of preferred embodiments herein described there is provided a method of forming a pool cover arrangement including: providing a first sheet of plastics material; providing a second sheet of plastics material; and fixing the first sheet to the second sheet and forming a number of cells; wherein said forming provides a first set of cells and a second set of cells; the first set of cells for providing heat insulation; the first set of cells provided for contacting the water; the second set of cells being inset relative to the first set of cells.

Preferably the second set of cells are inset by being of a reduced depth, relative to the first set of cells; the depth of each of the second set of cells being at least 1.5 mm; and the depth of each of the first set of cells being at least 3 mm.

Preferably the cells of the second set of cells are repetitively disposed between the cells of the first set of cells according to a repeating pattern.

Preferably the cells of the second set of cells are repetitively positioned between the cells of the first set of cells according to a repeating pattern to relatively evenly distribute the second set of cells over the body of the pool cover arrangement.

Preferably each ventilation passage has an inlet and an outlet for allowing chlorine gas to vent from the water; the inlet and the outlet of each ventilation passage being offset with respect to vertical, when the body is positioned on the water, the inlet and the outlets being offset to limit direct water exposure to sunlight during the middle of the day.

Preferably the inlets are disposed below the outlets, above the water level, when the body is positioned on the water, with the inlets being offset by at least 3 mm, in a direction in the horizontal plane.

According to an aspect of preferred embodiments herein described there is provided a method of forming a pool cover arrangement including: forming a number of holes in a first sheet of plastics material according to a first pattern; forming a number of holes in a second sheet of plastics material according to a second pattern; and fixing the first sheet to the second sheet to provide a number of cells; wherein the first pattern and the second pattern along with the fixing provide respective inlets and outlets in an offset position for limiting direct water exposure to sunlight during the middle of the day.

Preferably the inlets are disposed below the outlets, when the body is positioned on the water, with the inlets being offset by at least 3 mm, in a direction in the horizontal plane.

Preferably the pool cover arrangement comprises a flexible pool cover for covering a pool; the flexible pool cover being able to be rolled into a coil for storage.

According to an aspect of preferred embodiments herein described there is provided a pool cover comprising a number of cells having ventilation passages, the ventilation passages each providing an inlet and an outlet, wherein cells are configured support the inlets of the ventilation passages above the surface of the water.

Preferably the outlets are upwardly facing and the inlets are provided in side walls of the cells so as to be sidewards facing.

According to an aspect of preferred embodiments herein described there is provided a pool cover arrangement comprising: a body having a set of cells, the cells formed by a number of layers of plastics material; the body having a set of cells for floating on water; the layers of plastics material including a layer configured to preferentially allow the ventilation of chlorine gas.

Preferably the layer is configured to preferentially allow the ventilation of chlorine gas Preferably the layer is hydrophobic to limit evaporation Preferably the layer configured to preferentially allow the ventilation of chlorine gas comprises a non-woven polypropylene.

In a number of preferred embodiments it is considered advantageous to provide a first set of cells and a second set of cells wherein the second set of cells is inset relative to the first set of cells to provide a substantial water surface area to allow chlorine gas to vent through the passages.

It is considered that by being substantially offset with respect to vertical, there may be decreased evaporation during the middle of the day.

It is to be recognised that other aspects, preferred forms and advantages of the present invention will be apparent from the present specification including the detailed description, drawings and claims.

BRIEF DESCRIPTION OF DRAWINGS

In order to facilitate a better understanding of the present invention, several preferred embodiments will now be described with reference to the accompanying drawings, in which:

FIGS. 18*a* to 18*d* illustrate a pool cover arrangement according to another preferred embodiment of the present invention.

DETAILED DESCRIPTION OF THE EMBODIMENTS

It is to be appreciated that each of the embodiments is specifically described and that the present invention is not to be construed as being limited to any specific feature or element of any one of the embodiments. Neither is the present invention to be construed as being limited to any feature of a number of the embodiments or variations described in relation to the embodiments.

Figure 1:
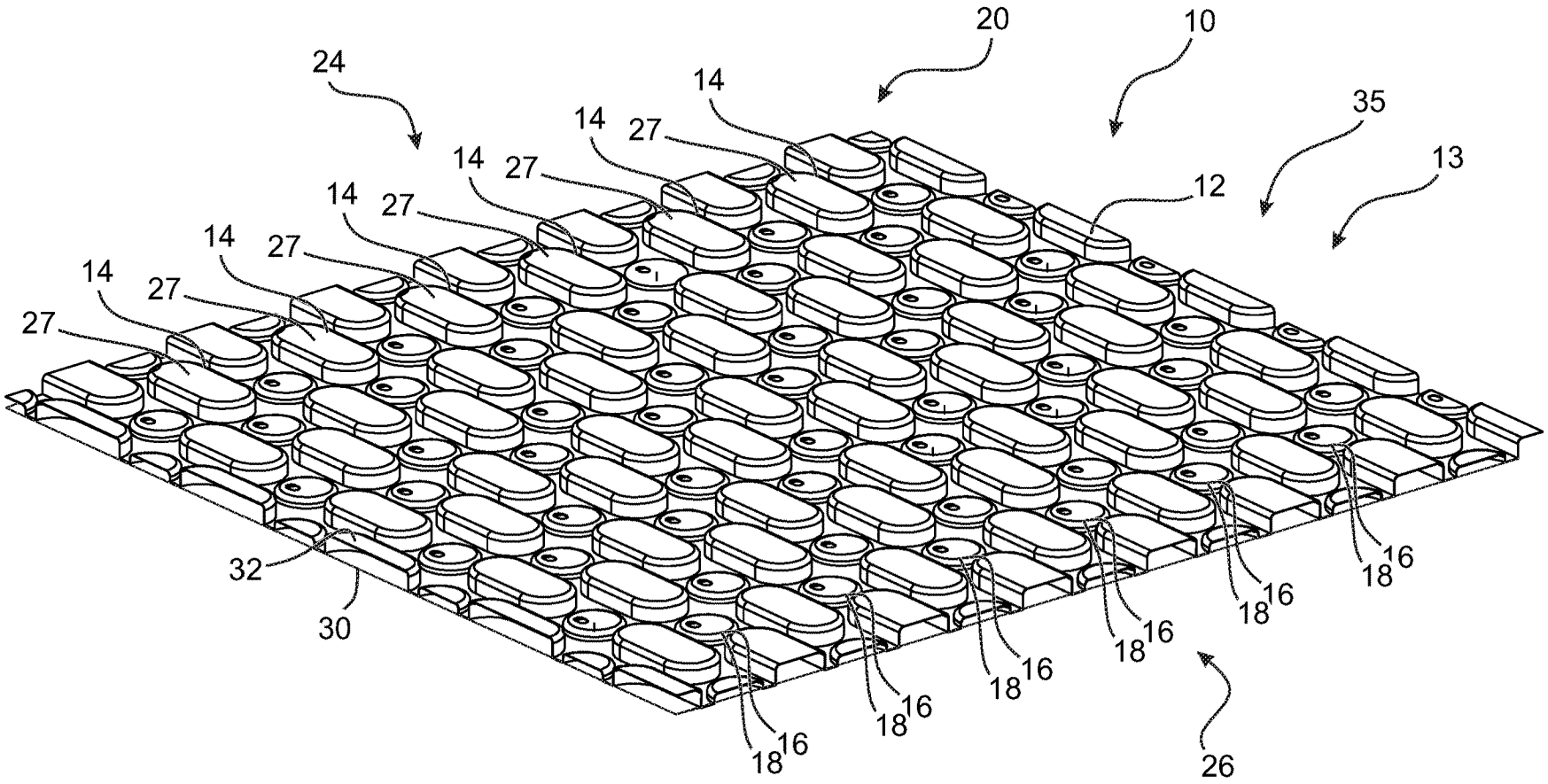
FIG. 1 provides perspective view of a pool cover arrangement according to a first preferred embodiment of the present invention FIG. 2 provides an illustrative perspective view of a ventilation cell forming part of the pool cover arrangement shown in FIG. 1.

Referring to FIG. 1, there is shown a pool cover arrangement 10 according to a first preferred embodiment of the present invention. It is to be appreciated that the pool cover arrangement 10 provides a section of a pool cover (not shown). A pool cover is provided in other embodiments.

The pool cover arrangement 10 comprises a body 12 of a cell construction, the cell construction being provided by fixing and forming flexible plastics layers. Such fixing and forming by conventional processes is well known in pool cover manufacturing.

In the pool cover arrangement 10, the body 12 provides a flexible evaporation blanket 13. The flexible evaporation blanket 13 is flexible in that the blanket 13 is able to be rolled into a cylinder for storage purposes.

The body 12 provides a number of elongate closed cells 14 that repeat across and along the pool cover arrangement 10. The closed cells 14 are elongate and tap air to provide the body 12 with a density lower than the density of water. This allows the pool cover arrangement 10 to float on a pool or another body of water.

The body 12 of the pool cover arrangement 10 includes a number of open cells 16 that provide advantageous ventilation cells 18. The ventilation cells 18 are advantageously inset by being of a shallower depth, relative to the extent of the closed cells 14.

Figure 2:
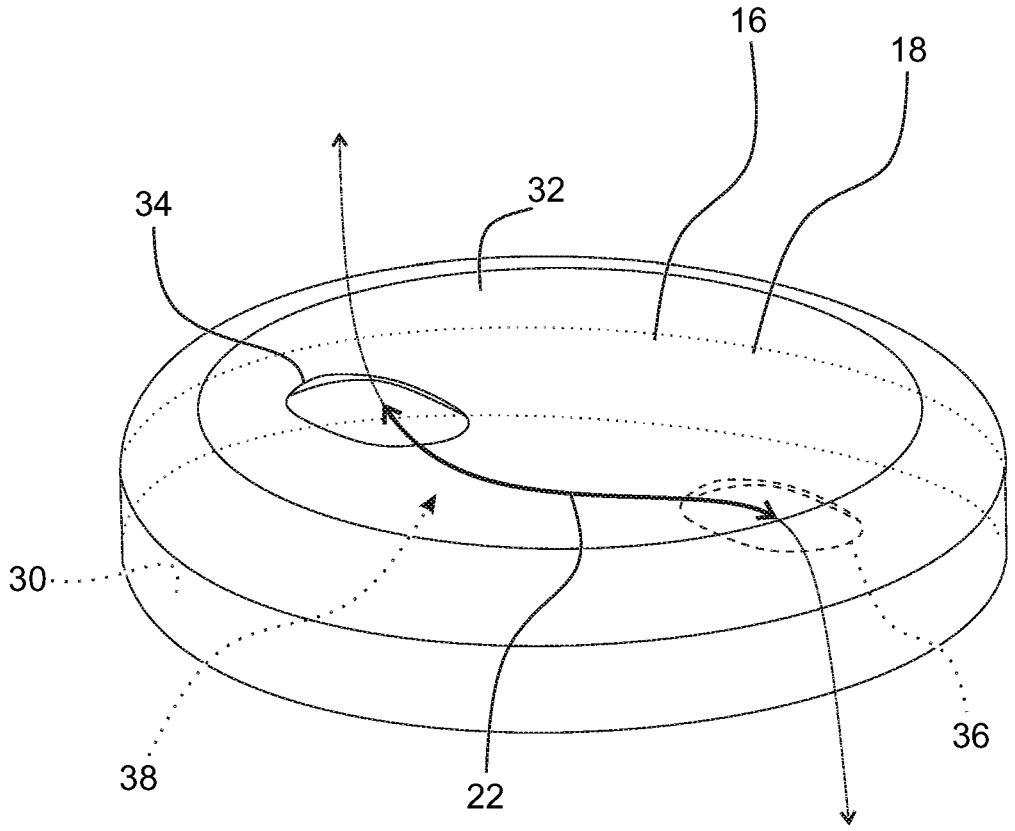

As shown in FIG. 2, the ventilation cells 18 provide the body 12 with ventilation passages 22 that extend through the body 12 of the pool cover arrangement 10. The ventilation cells 18 are of a circular shape and repeat across and along the pool cover arrangement 10. Each ventilation cell 18 is provided with an inlet 34 and an outlet 36 having a connecting cell area 38 therebetween. Apart from the inlet 34 and the outlet 36, each ventilation cell 18 would otherwise closed.

The cells 16 and the cells 18 are provided as a group of cells 20. The cells 20 provide the closed cells 14 as a first set of cells 24, each being of an elongate shape. The cells 20 provide the open cells 16 as a second set of cells 26, each being of a circular shape.

The first set of cells 24 are provided as an insulating layer and act as insulation. The first set of cells 24 allow the pool cover arrangement 10 to float, with the first set of cells 24 contacting the water so as to float on the outward surfaces 27 of the first set of cells 24.

The second set of cells 26 are inset relative to the first set of cells 24 so as not to provide any water contact surfaces. Consequently, rather than the cells 26 contacting the water, the cells 26 are inset to expose an increased water surface area 28 (as shown in FIG. 3) from which chlorine gas is able to vent through the ventilation passages 22.

Thus there is provided a pool cover arrangement 10 comprising: a body 12 having a first set of cells 24 and a second set of cells 26. The first set of cells 24 provide a first area 35 for floating on water. The first area 35 comprises the forward facing areas 27 of the first set of cells 24. The second set of cells 26 are spaced away from the forward facing areas 27, so as to sit above the water, when the first set of cells 24 sit on the water.

Figure 3:
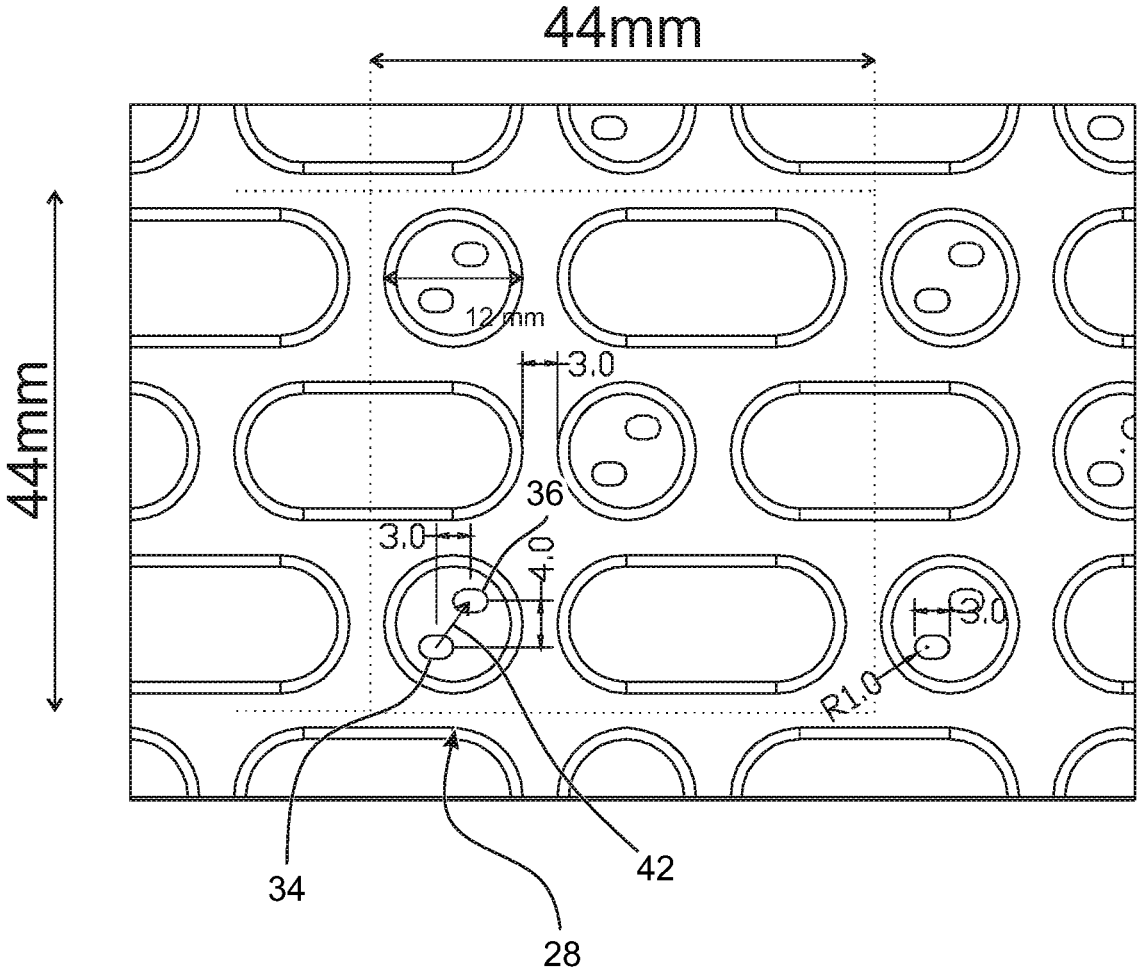
FIG. 3 provides a top view of a section of the pool cover arrangement shown in FIG. 1.

FIG. 3 shows a repeating area marked A of approximately 44 mm in width and height. The increased surface area is provided by three cells 26 of a diameter of about 12 mm. This provides an increased surface area. This space would otherwise be occupied by the first cells 24.

The pool cover arrangement 10 comprises and upper surface 30 and a lower surface 32. The upper surface 30 is flat and the lower surface 32 is undulating (FIGS. 1 and 2 show the pool cover arrangement 10 upside down for ease of reference). The ventilation passages 22 extend from the lower surface 32 to the upper surface 30.

Each of the passages extends from an inlet 34 to an outlet 36 and provides a connecting cell area 38 therebetween. Whilst the connecting cell area 38 is open, by virtue of the inlet 34 and the outlet 36, the cells 26 are still considered to provide an advantageous degree of insulation. The cells 26 are disposed above the water surface and tend not to fill with water.

The most advantageous sizing for the size of the inlet 34, the connecting cell area 38 and the outlet 36 is still yet to be determined. The applicant is conducting some further testing. It is considered that the smaller the inlet 34 and the outlet 36, the better for reducing evaporation. On the other hand, it is considered that the larger the inlet 34 and outlet 36 the better for reducing chlorine build-up. Some of the inlets 34 and the outlets 36 may be larger than others to allow for rain water drainage into the pool.

The second set of cells 26 are inset in connection with the lower water contacting surfaces 27 provided by the first set of cells 24. The second set of cells 26 are arranged to be disposed above the water level with the first set of cells 24 contacting the water. The first set of cells 24 comprise sealed air cells ('closed cells') having no ventilation passages 22.

Figure 4:
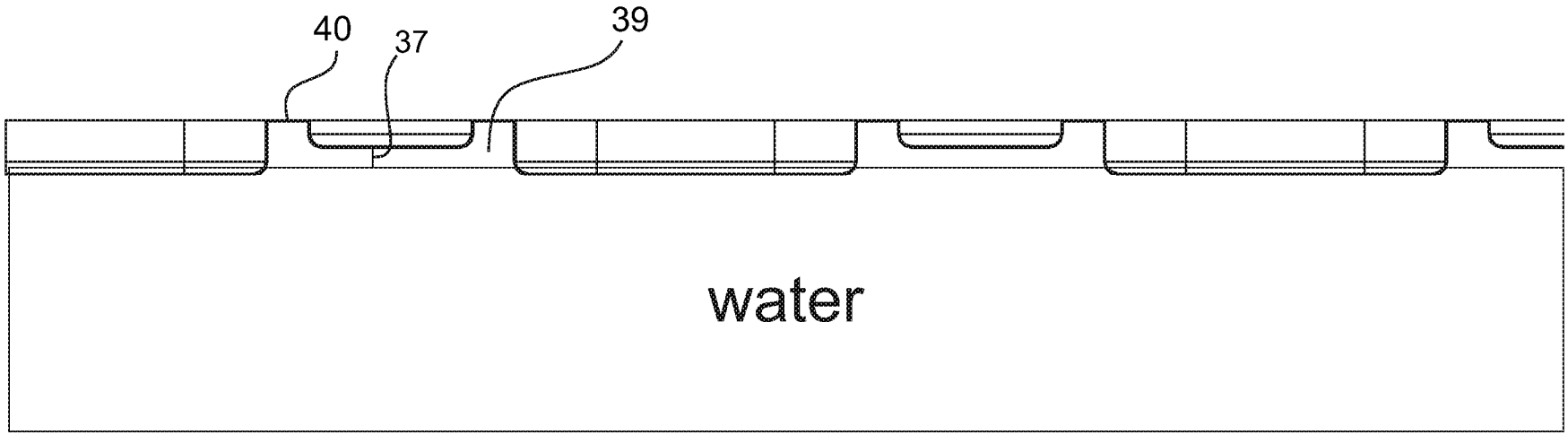
FIG. 4 provides a side view of the pool cover arrangement shown in FIG. 1, when positioned on water FIG. 5 provides an enlarged cutaway view of the pool cover arrangement shown in FIG. 1.

Referring to FIG. 4, with the inlets 34 disposed above the water level there is provided a first interconnected volume 39 for the accumulation of chlorine gas, from which the chlorine gas is able to escape through the inlets 34, into the connection cell areas 38 and out the outlets 36. A high accumulation of chlorine gas in the interconnected volume 39 is not envisaged due to the presence of the ventilation passages 22 and increased interconnected volume. A reduction in chlorine gas build-up may be caused by general dispersion as well as air flow effects above the pool cover arrangement 10.

In the embodiment the first set of cells 24 and the second set of cells 26 extend from a base 40. The first set of cells 24 extend a depth of about 4 mm, from the base 40. The second set of cells 26 extend a depth of about 2 mm, from the base 40.

In this manner the second set of cells 26 are inset away from the water contact surface, by being of a reduced depth, relative to the first set of cells 24. The depth of each of the second set of cells 26 is preferably at least 1.5 mm; and the depth of each of the first set of cells 24 is preferably at least 3 mm. Other embodiments may be provided. Preferably the second set of cells 26 are spaced a distance 37 of at least 1.5 mm from the surface of the body of water.

Figure 5:
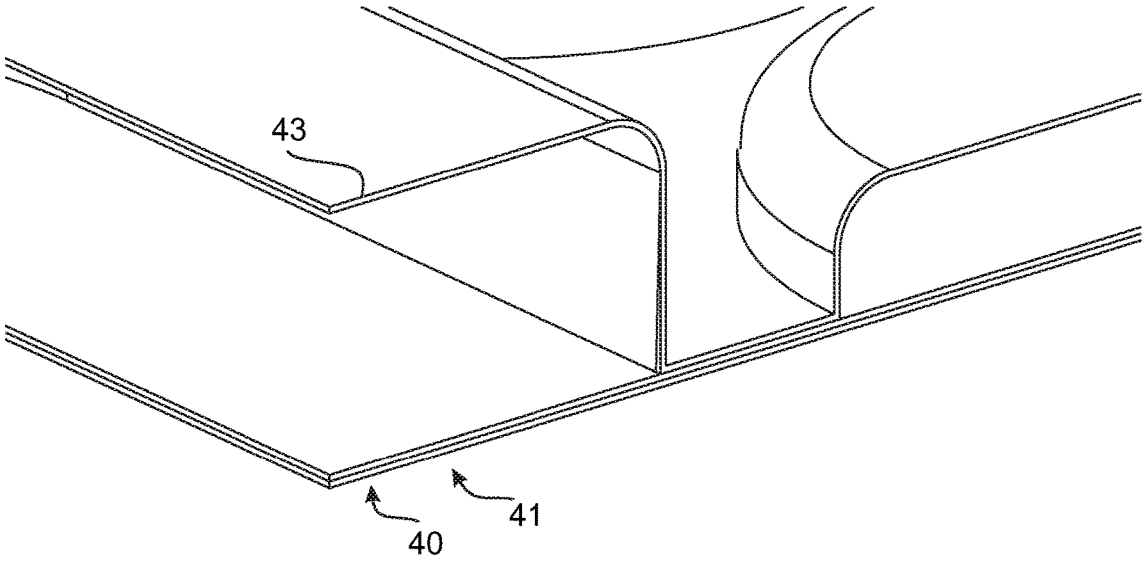

Referring to FIG. 5, the base 40 provides a double layer 41 from which at least one other sheet 43 is fixed to provide the cells 24 and the cells 26. In various embodiments the layer 41 is reflective into or out of the pool for controlling pool temperature.

The cells of the second set of cells 26 are repetitively positioned between the cells of the first set of cells 24. The cells of the second set of cells 26 are relatively evenly distributed along and across the body 12 of the pool cover arrangement 10. This provides for relatively consistent chlorine gas reduction along the full surface of the arrangement 10.

As shown, the cells of the second set of cells 26 are relatively consistently distributed across and along the poor cover arrangement 10. That is, they are not preferentially/particularly distributed in one particular area of the pool cover arrangement 10.

Referring to FIG. 3, the inlet 34 and the outlet 36 of each ventilation passage 22 are offset in a direction 42. An inlet 34 and an outlet 36 are associated with each ventilation cell 18 and allow chlorine gas to vent from the water through the cell.

The inlet 34 and the outlet 36 of a corresponding cell, are offset with respect to vertical, when the body 12 of the pool cover arrangement 10 is positioned on the water. This is considered to advantageously limit direct water exposure to sunlight during the middle of the day, say between 11 am and 2 pm.

By the inlet 34 and the outlet 36 being offset and spaced apart, reduced evaporation is considered to be provided during the hotter parts of the day. The applicant is presently investigating the degree of advantage provided and preferred angles, sizes and spacing's. The degree of advantage is envisaged to depend on the inlet hole size, the outlet hole size and possibly a range of other factors.

In the embodiment shown, each inlet 34 is disposed below the corresponding outlet 36 of a ventilation cell 26, above the water level. Each inlet 34 is offset from the outlet 36 by at least 3 mm, in a direction 42 in the horizontal plane.

The inlets 34 and the outlets 36 are formed during the moulding of the pool cover arrangement 10.

Referring to FIG. 5, the lower air cell layer is provided by a single layer 43. The upper air cell layer is provided by a double layer 41. The first set of cells 24 and the second set of cells 26 are each formed from at least two of the same layers of plastics material. In the embodiment they are formed from the same upper layers and lower layers.

Figure 6A:
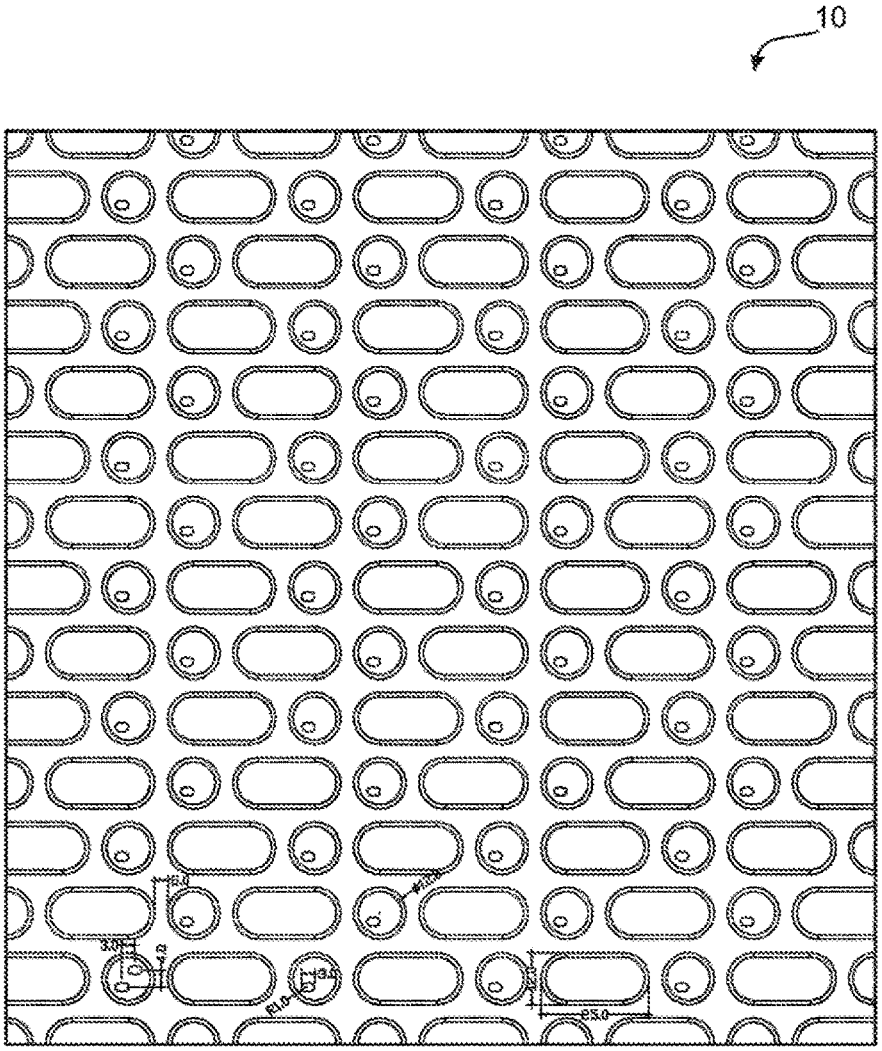
FIGS. 6*a* to 6*c* provide three views of the pool cover arrangement shown in FIG. 1.
Figure 6C:
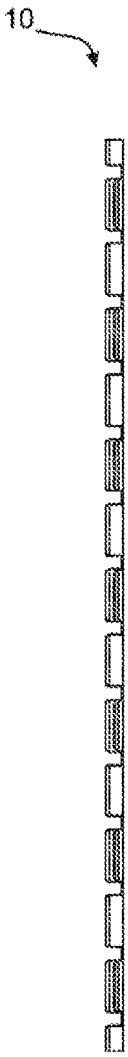
Figure 6B:
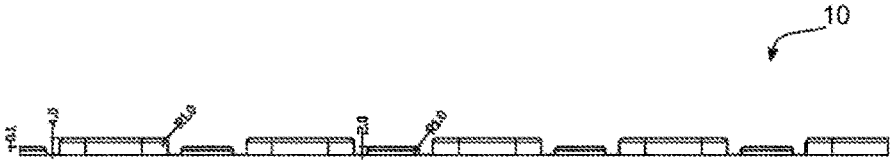

FIG. 6 provides three views of the pool cover arrangement 10. Various views are provided including a side view and an illustrative side view.

Figure 7:
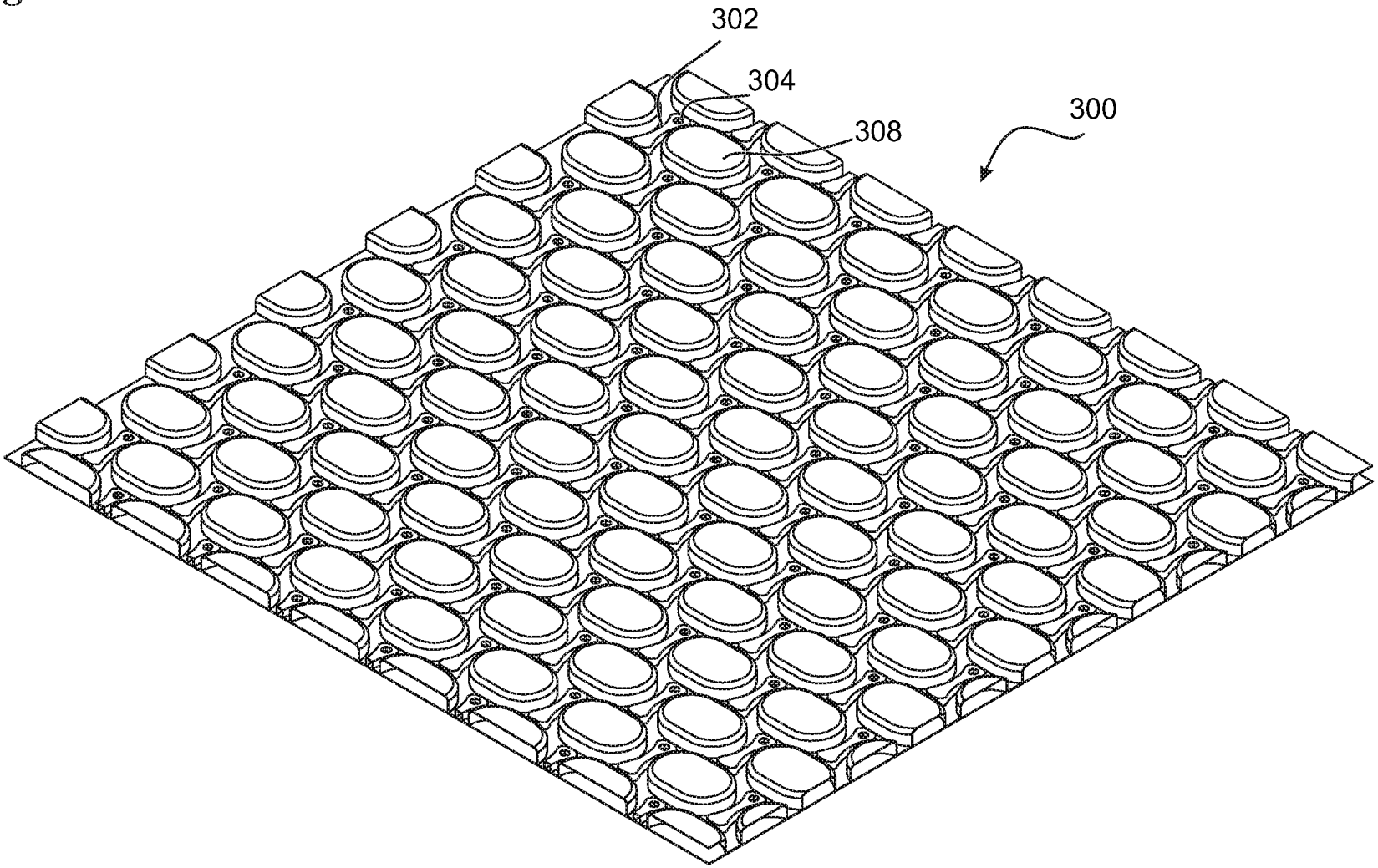
FIG. 7 provides perspective view of a pool cover arrangement according to a second preferred embodiment of the present invention.
Figure 8A:
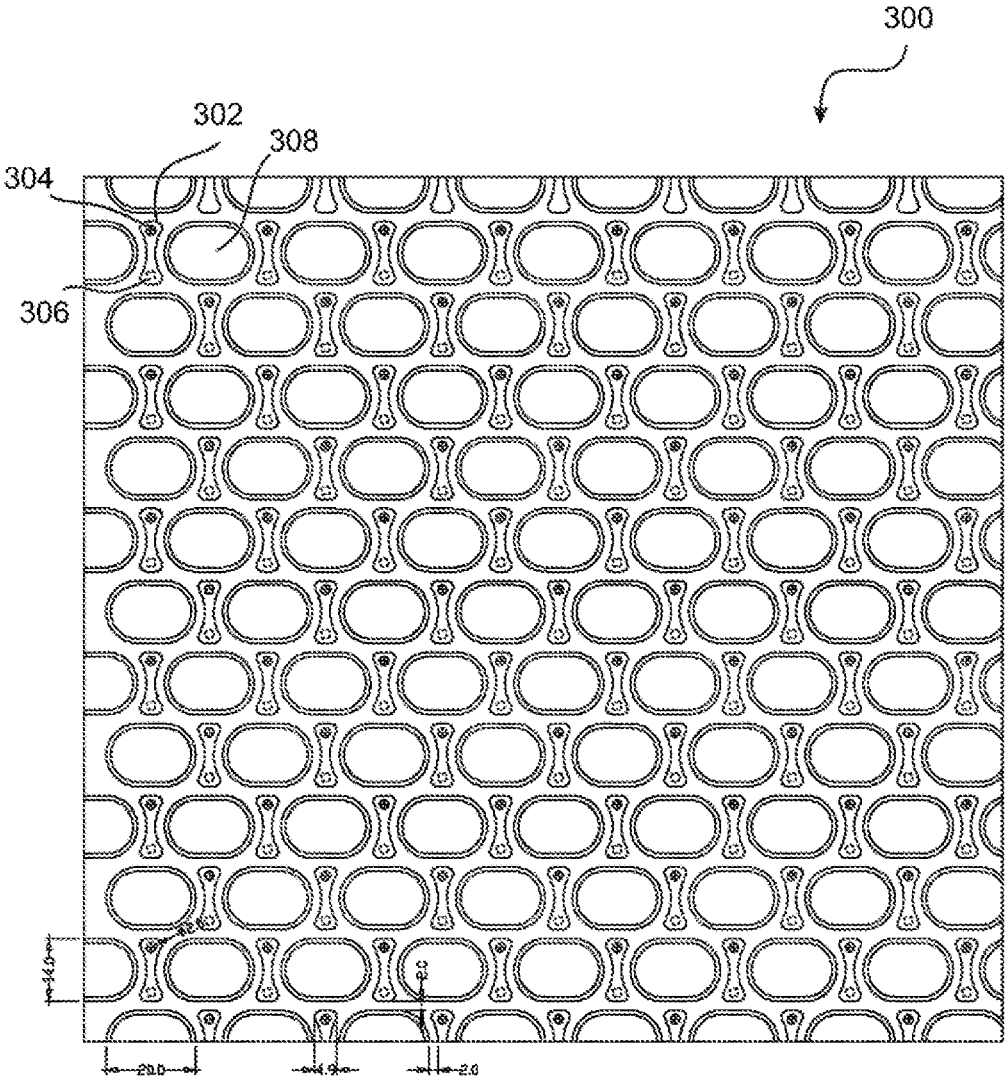
FIGS. 8*a* to 8*b* provide two views of the pool cover arrangement shown in FIG. 7.
Figure 8B:
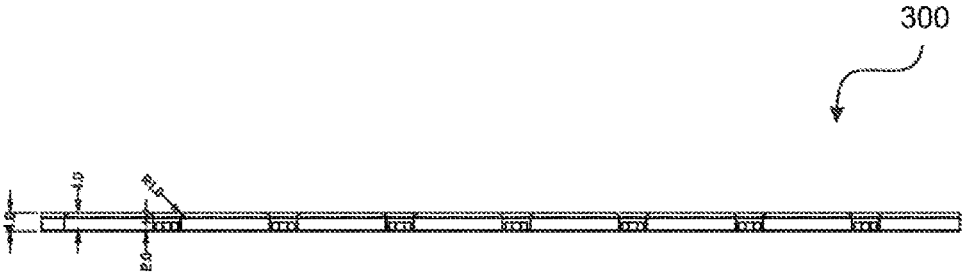

FIGS. 7 and 8 provide an illustration of a further preferred pool cover arrangement 300 according to another embodiment wherein ventilation cells 302 comprise elongate cells having an inlet 304 and an outlet 306 at opposite ends of the cell. The ventilation cells 302 are arranged at 90 degrees to separating floatation cells 308.

Figure 9:
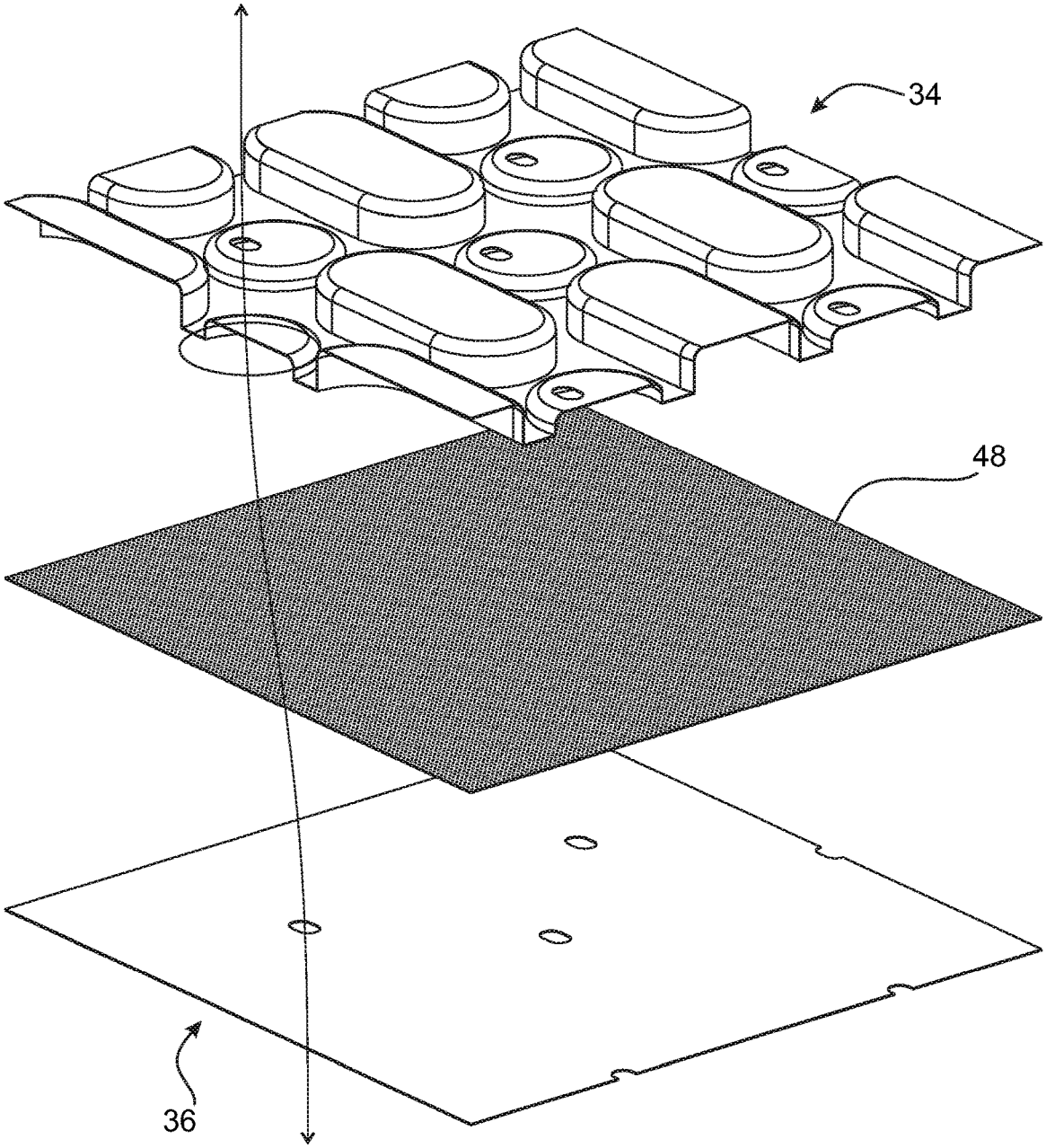
FIG. 9 provides perspective view of a pool cover arrangement according to a third preferred embodiment of the present invention.

In another arrangement shown in FIG. 9, there is provided a chlorine gas permeable layer 48. The chlorine gas permeable layer 48 is configured to preferentially allow the ventilation of chlorine gas through the ventilation holes whilst limiting the passage of water vapour therethrough. The possibility of providing such a layer is presently being investigated by the applicant.

Figure 10B:
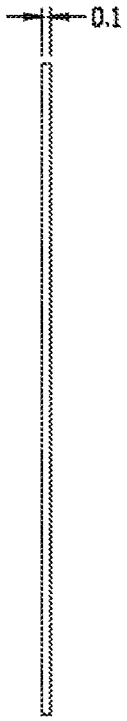
FIGS. 10*a* to 10*c* provides two views of a layer forming part of the pool cover arrangement shown in FIG. 1.
Figure 10A:
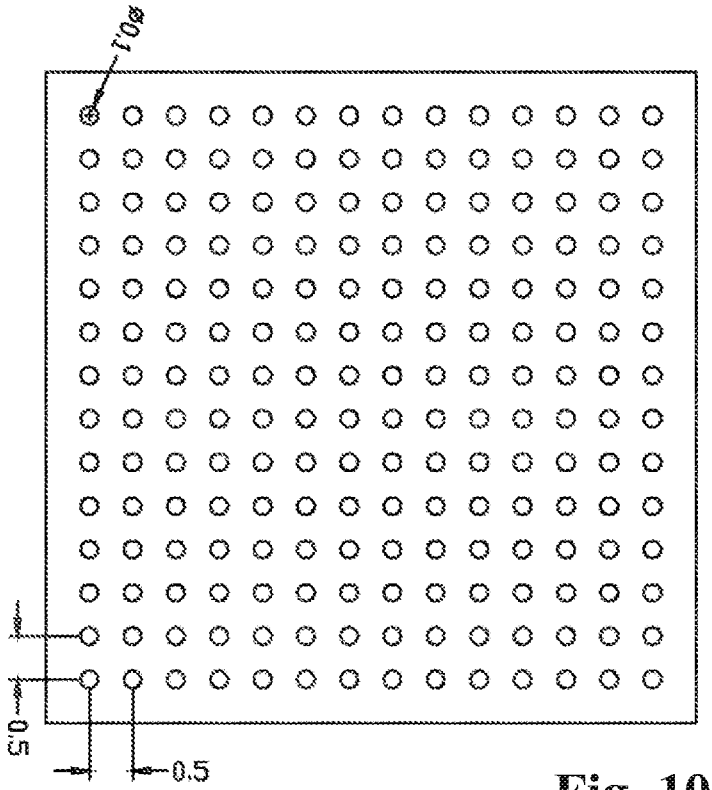
Figure 10C:
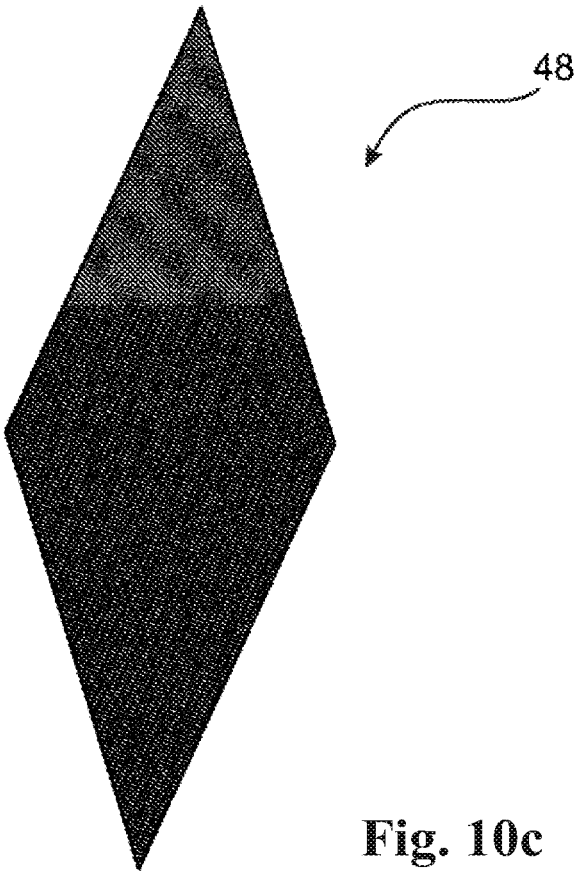
Figure 11B:
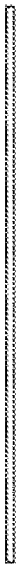
FIGS. 11*a* to 11*c* provides two views of a layer forming part of the pool cover arrangement shown in FIG. 1.
Figure 11A:
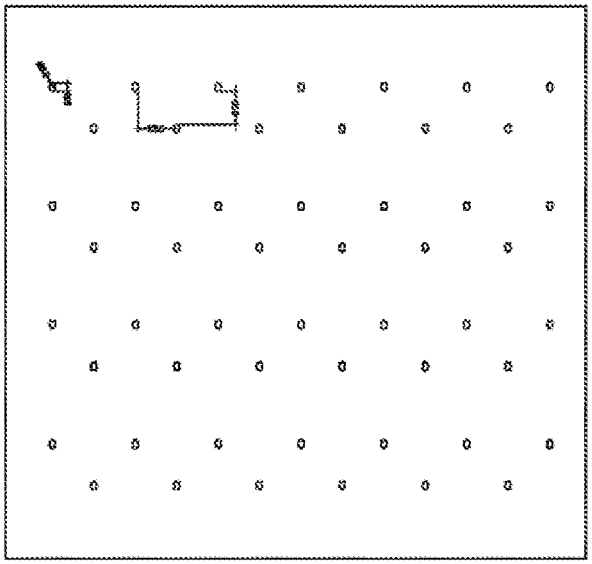
Figure 11C:
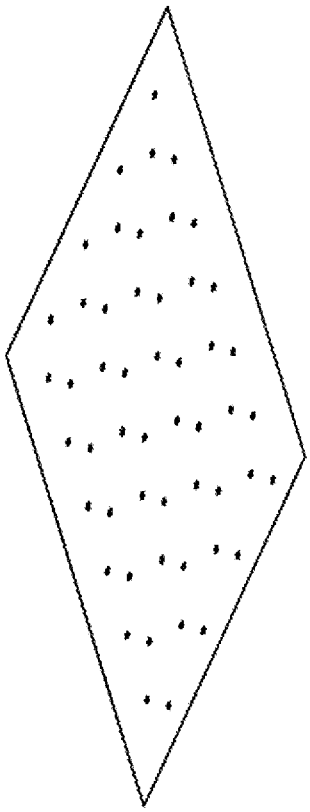

As shown, the layer 48 is sandwiched between the layers providing the inlets 34 and the outlets 36. In other embodiments the layer 48 provides the lower layer with the outlets 36 integrally formed therein. The applicant is presently investigating various layers and membranes adapted to preferentially allow the ventilation of chlorine gas through the ventilation passages 22. FIG. 10 illustrates a layer 48 having a 0.5 mm square spacing and a 0.1 mm repeating hole. FIG. 11 shows a possible spacing of the outlets 36.

In connection with a chlorine gas permeable layer 48, the applicant considers that it is possible to use a non-woven polypropylene. Notably, this is the same type of product that the blankets are made of. The layer 48 is breathable but will resist the passage of water vapour through it, so the chemical gas can escape but will resist evaporation, meaning, if required, we can have larger holes for the chemical to escape to allow a high percentage of area. The exact type of non-woven polypropylene for this purpose is being investigated by the applicant.

In an aspect there may be provided a pool cover arrangement comprising: a body having a set of cells, the cells formed by a number of layers of plastics material; the body having a set of cells for floating on water; the layers of plastics material including a layer configured to preferentially allow the ventilation of chlorine gas.

Whist the embodiment described has inset cells, it is to be appreciated that other embodiments may not. Such embodiments include those having all cells of the same depth with the inlets and the outlets of each ventilation passage 22 being offset with respect to vertical.

Figure 12:
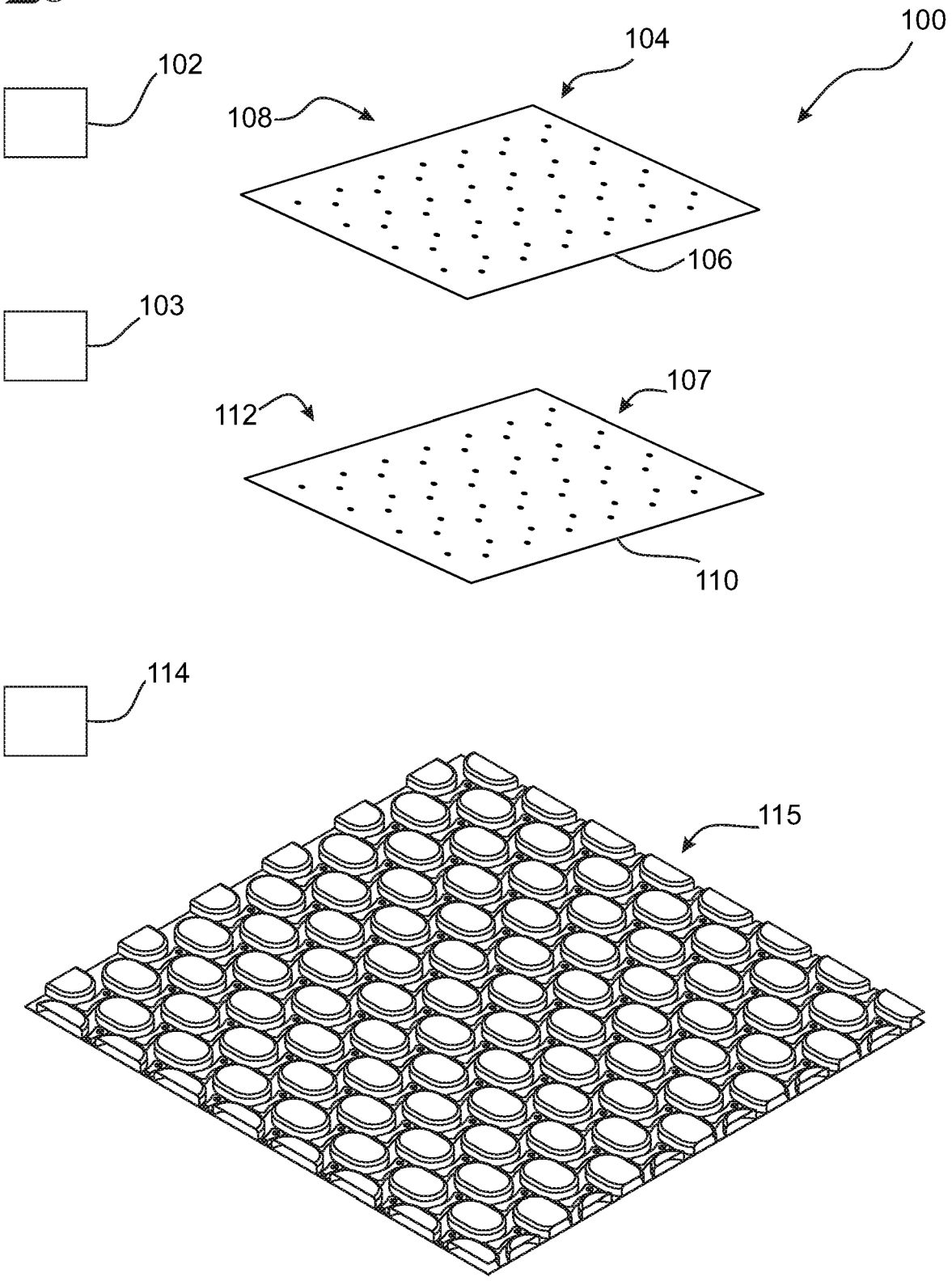
FIG. 12 provides perspective view of a method according to another preferred embodiment of the present invention.

Referring to FIG. 12 there is shown a method 100 according to another preferred embodiment of the present invention. At block 102 the method 100 includes forming a number of holes 104 in a first sheet of plastics material 106, the holes 104 being formed according to a first pattern 108. At block 103 the method 100 includes forming a number of holes 107 in a second sheet 110 of plastics material, the holes 106 being formed according to a second pattern 112.

At block 114, the method 100 includes fixing the first sheet 106 to the second sheet 110 to provide a number of cells 115. Notably block 102, block 112, and block 114 occur at the same time during moulding. At block 114, in the method 100, the first pattern 108 and second pattern 100 along with the fixing provide respective inlets and outlets in an offset condition for limiting direct water exposure to sunlight during the middle of the day. This has been previously described. The method 100 is used to produce the pool cover arrangement 10. Various other methods could also be used in forming the pool cover arrangement.

Figure 13:
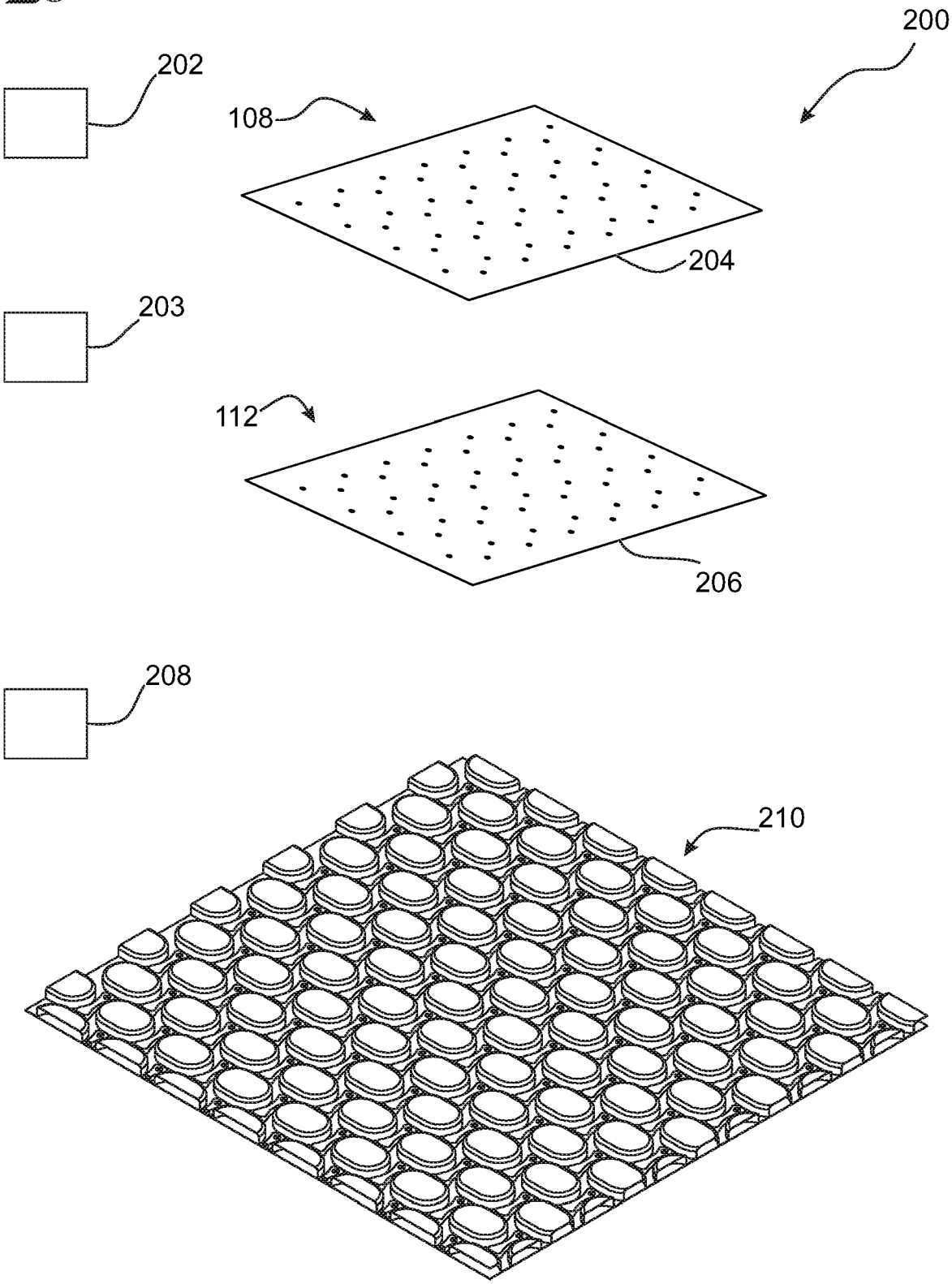
FIG. 13 provides perspective view of a method according to another preferred embodiment of the present invention.

Referring to FIG. 13 there is shown a method 200 according to a third preferred embodiment of the present invention. At block 202 the method 200 includes providing a first sheet 204 of plastics material. At block 203 the method 200 includes providing a second sheet 206 of plastics material. At block 208 the method 200 includes fixing the first sheet 204 to the second sheet 206 to and forming a number of cells 210. The fixing and forming provides a first set of cells and a second set of cells. The first set of cells provide for heat insulation and water contact. The second set of cells are formed so as to be inset relative to the first set of cells with the second set of being inset to expose an increased water surface area from which chlorine gas is able to vent through a number of ventilation passages, when the body of the pool cover arrangement is positioned on the water. This has been previously described. The method 100 is used to produce the pool cover arrangement 10. Various other methods could also be used in forming the pool cover arrangement.

The second set of cells are formed so as to be inset, that is located further inwardly, away from the water facing side of the pool cover arrangement 10.

It is considered that the pool cover arrangement is different to anything else on the market as it will allow the pool to release the chlorine gases that accumulate under the pool cover advantageously with insulating bubbles. As described the design has a deeper and shallower bubble. The deeper bubble allows the product to operate as a traditional blanket, keeping the pool warm and helping with evaporation. This bubble sits directly on the water and allows the blanket to float.

The shallow bubble sits off the water and has two (2) offset holes in it, this allows any chlorine gases to escape and ensures the pool is not over chlorinated. The holes are offset so that there is no direct sunlight on the pool. Through these small holes, it is not expected to lose a substantial amount of water through evaporation whilst the blanked is still expected to keep substantially the same heating performance as a standard blanket.

The reason behind releasing the gases from the pool is that high chlorine damages the pool surface and any products inside the pool. Typical products that could be left inside the pool include pool cleaners and baskets. Excessive chlorine is also known to deteriorate pool covers.

Figure 14:
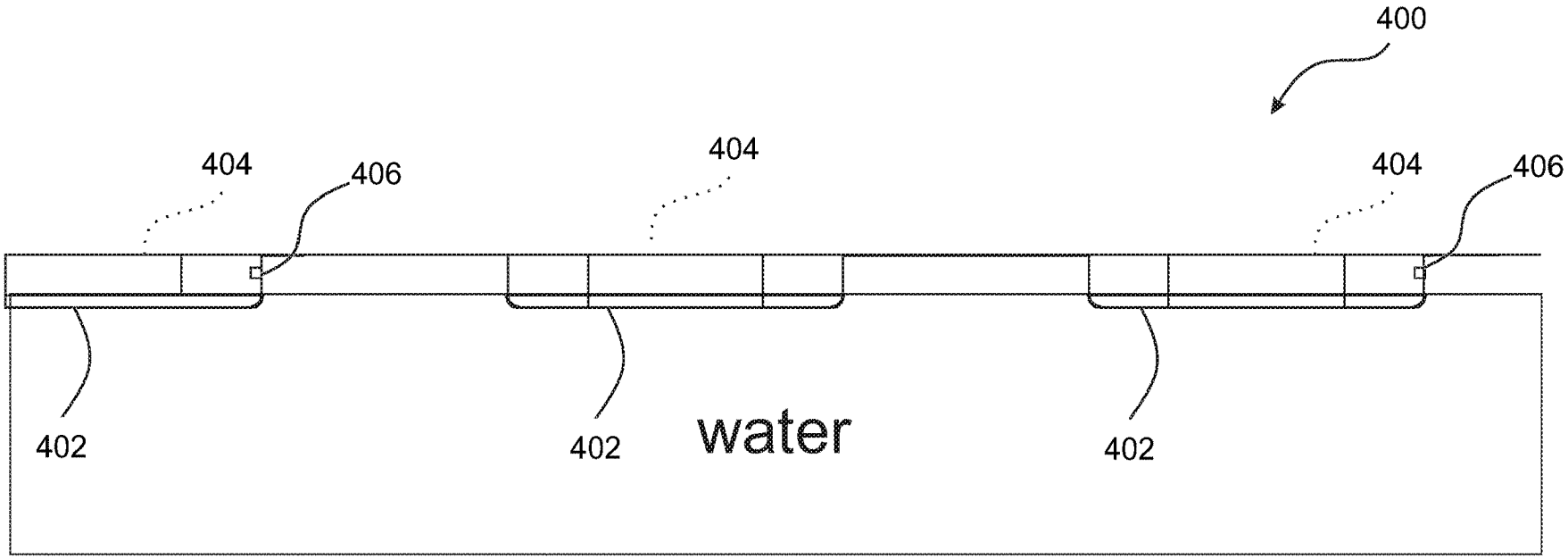
FIG. 14 provides side view of a pool cover arrangement according to another preferred embodiment of the present invention.
Figure 15A:
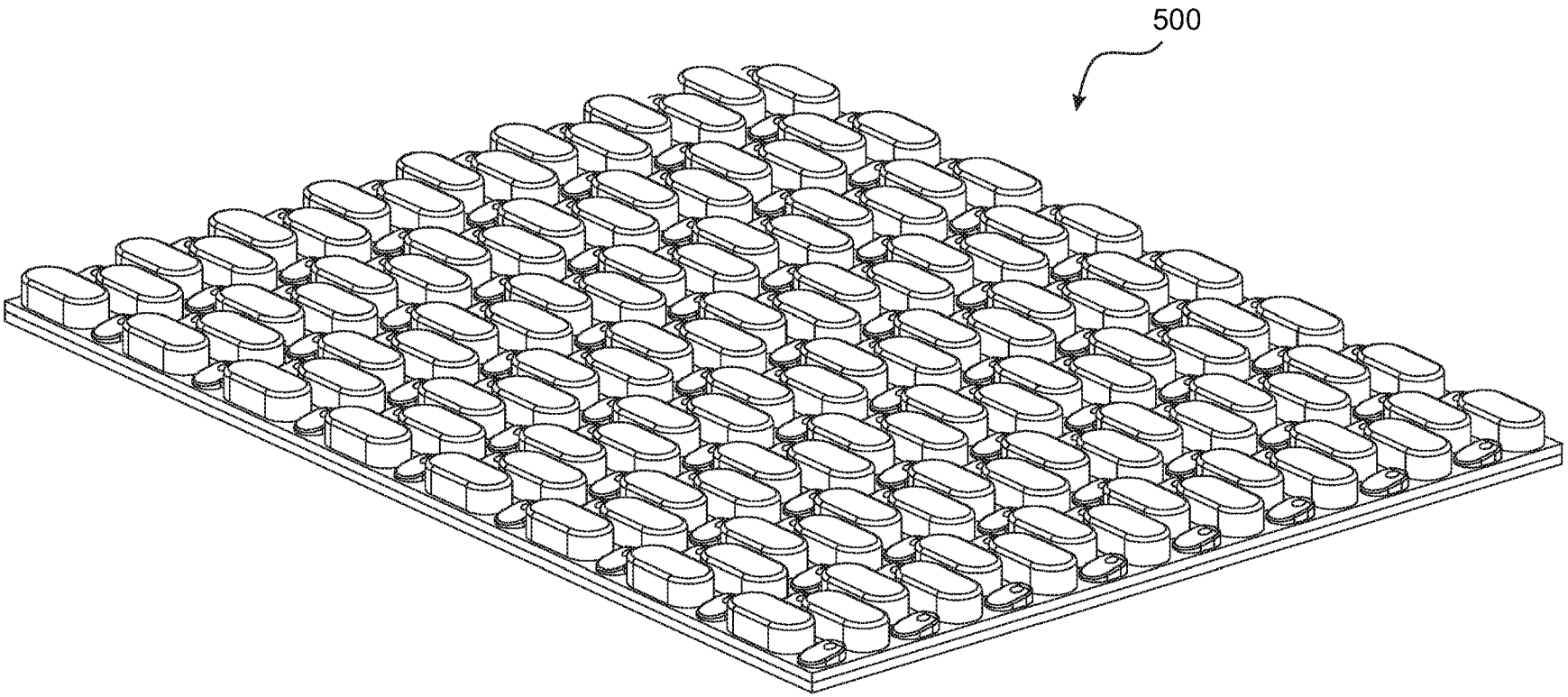
FIGS. 15*a* to 15*d* show a pool cover arrangement according to another preferred embodiment of the present invention.
Figure 15B:
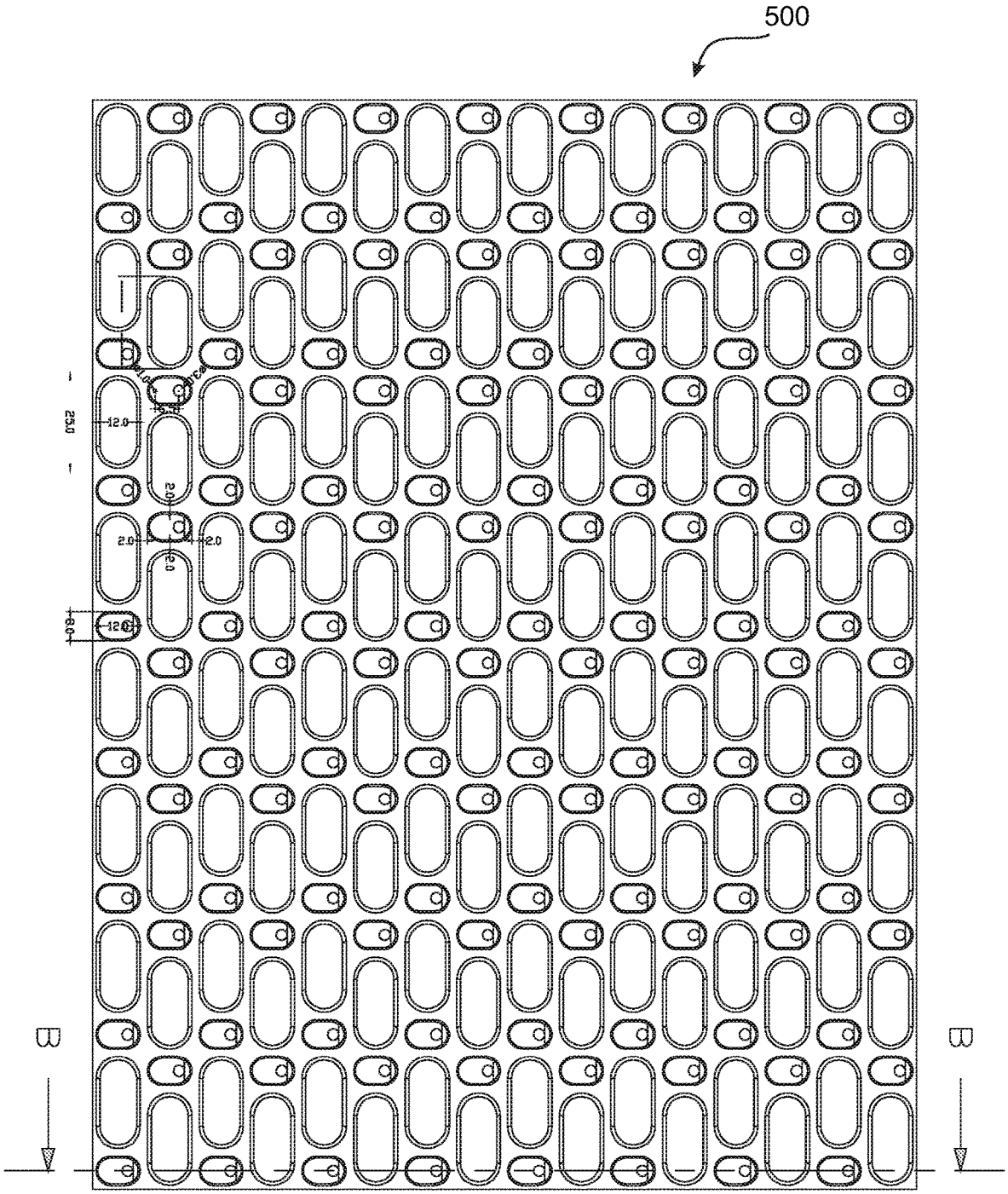
Figure 15C:
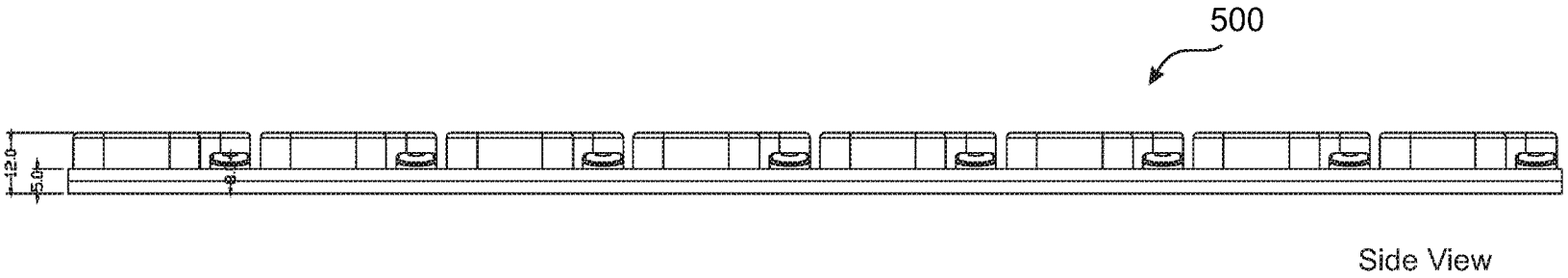
Figure 15D:
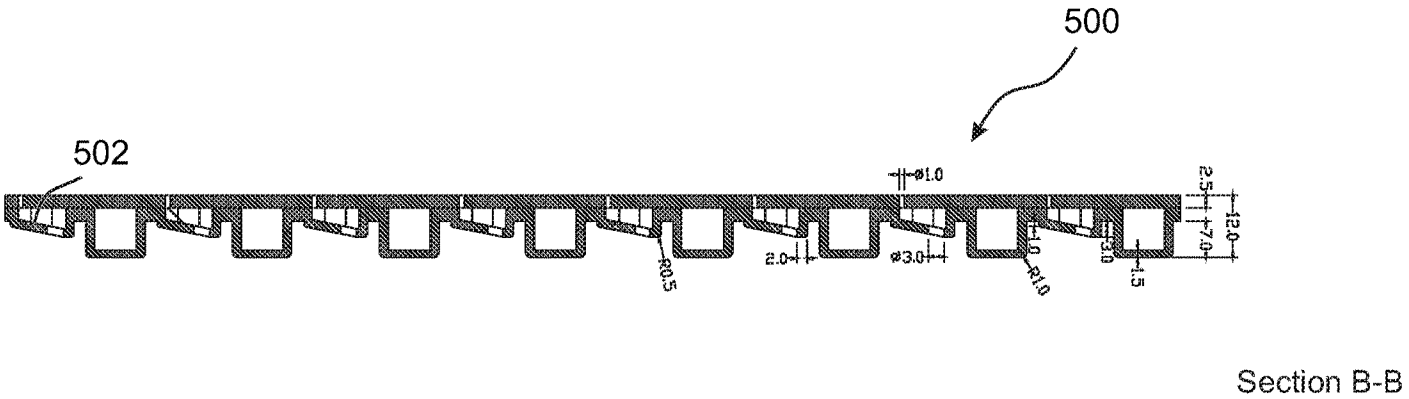

According to another preferred embodiment shown in FIG. 14 there is provided a pool cover 400 comprising a number of cells 402 having ventilation passages 404. The ventilation passages 404 each provide an inlet 406 on the side walls of each alternating cell 402 and an outlet (as before), wherein cells are configured support the inlets 406 of the ventilation passages 404 above the surface of the water. The embodiment accordingly has sideways facing inlets 406 (rather than downwardly facing inlets).

The provision of some of the cells being closed cells ensures floating of the pool cover 400, while the other cells allow for venting, while still having offset inlets and outlets to limit evaporation during the heat of the day.

Referring to FIG. 15 there is shown a pool cover arrangement 500 according to another preferred embodiment in which the second cells each provide a ventilation passage having a downwardly directed lower wall 502 for directing water, if present in the bubble, downwardly through the ventilation passage into the pool when the pool cover is positioned thereon. The lower wall 502 is slanted and provides a gradient of about 10 degrees.

Each of the second cells extends a shorter distance that each of the first cells. Thus there is provided a sloping bubble in combination with the earlier described deep bubble and shallow bubble. There are different sized holes top and bottom of each ventilation passage. The vented bubble could of course be different shapes and sizes.

Figure 16:
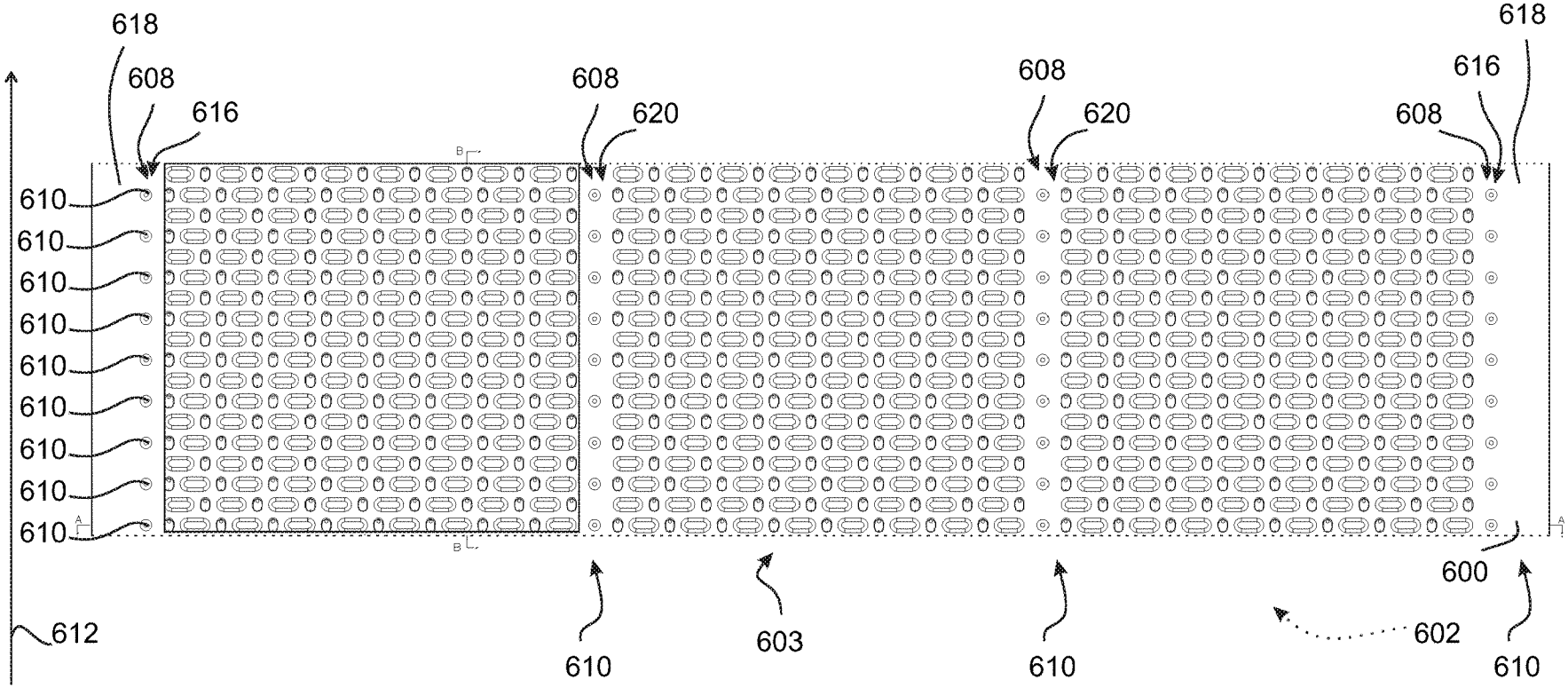
FIG. 16 illustrates a pool cover arrangement according to another preferred embodiment of the present invention.
Figure 17A:
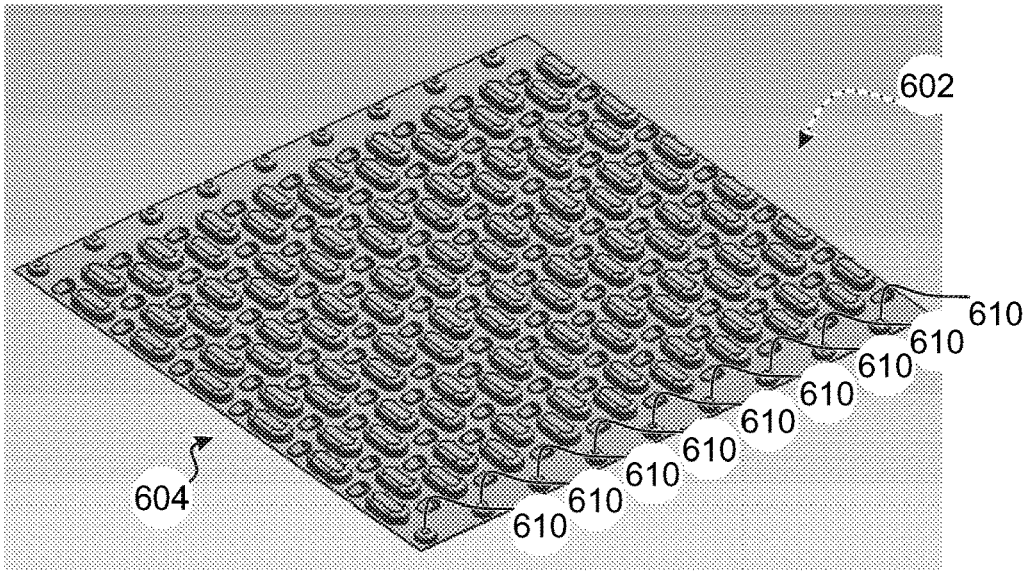
FIGS. 17*a* to 17*c* illustrate a pool cover arrangement according to another preferred embodiment of the present invention.
Figure 17B:
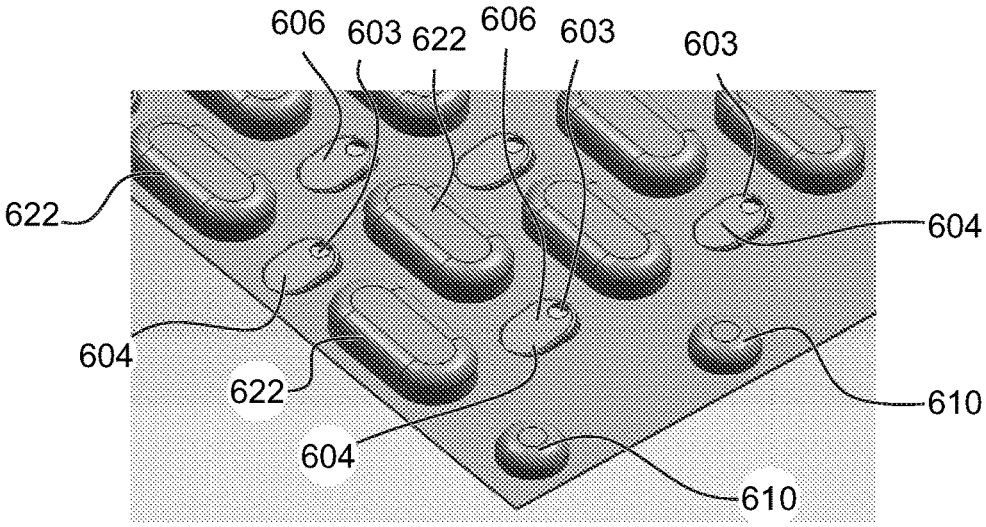
Figure 17C:
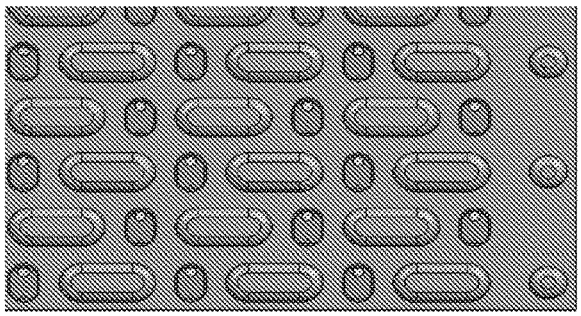

FIG. 16 shows a section 600 of a pool cover arrangement 602, the arrangement according to a further preferred embodiment of the present invention. FIGS. 17*a* to 17*d* provide a number of enlarged views of the section 600. With reference to FIG. 16, the section 600 extends along the width of the pool cover arrangement 602. The pool cover arrangement 602 has a body in which the inlets 603 are spaced above the water level. As with the previous embodiments there is provided a second set of cells 604 having faces 606 for sitting above the surface of the water. In some embodiments the second set of cells 604 could each extend into the water and float thereon. The faces 606 are arranged at an angle relative to the water to assist with drainage as previously described. The inlets 603 are spaced above the level of the water.

The pool arrangement 600 includes four runs 608 of location cells 610 each arranged in series along the length 612 of the body of the pool arrangement 630. The runs 608 advantageously comprise lengths for being received in tracks of a press. The four lengths 608 of location cells 610 comprise two lengths 616 on the side portions 618 of the pool cover arrangement 600 and two lengths 620 spaced therebetween. The second set of cells 604 are spaced between the run 608 (along with a first set of cells 622).

FIG. 18*a* provides a lengthwise side view of the section 600. FIG. 18*b* shows a section of one of the second set of cells 604 with the face 606 and thin walled construction providing for drainage when water finds its way into the cell. The inlet 626 is larger in area than the outlet 628.

FIG. 18*c* provides a sectional view. FIG. 18*d* provides a width-wise side view of the section 600. The areas 624 of the first and second cells between the lengths 608 are substantially greater than the areas of each length 608. In this embodiment an area 624 is about 9 times larger (for a set length).

Figure 19:
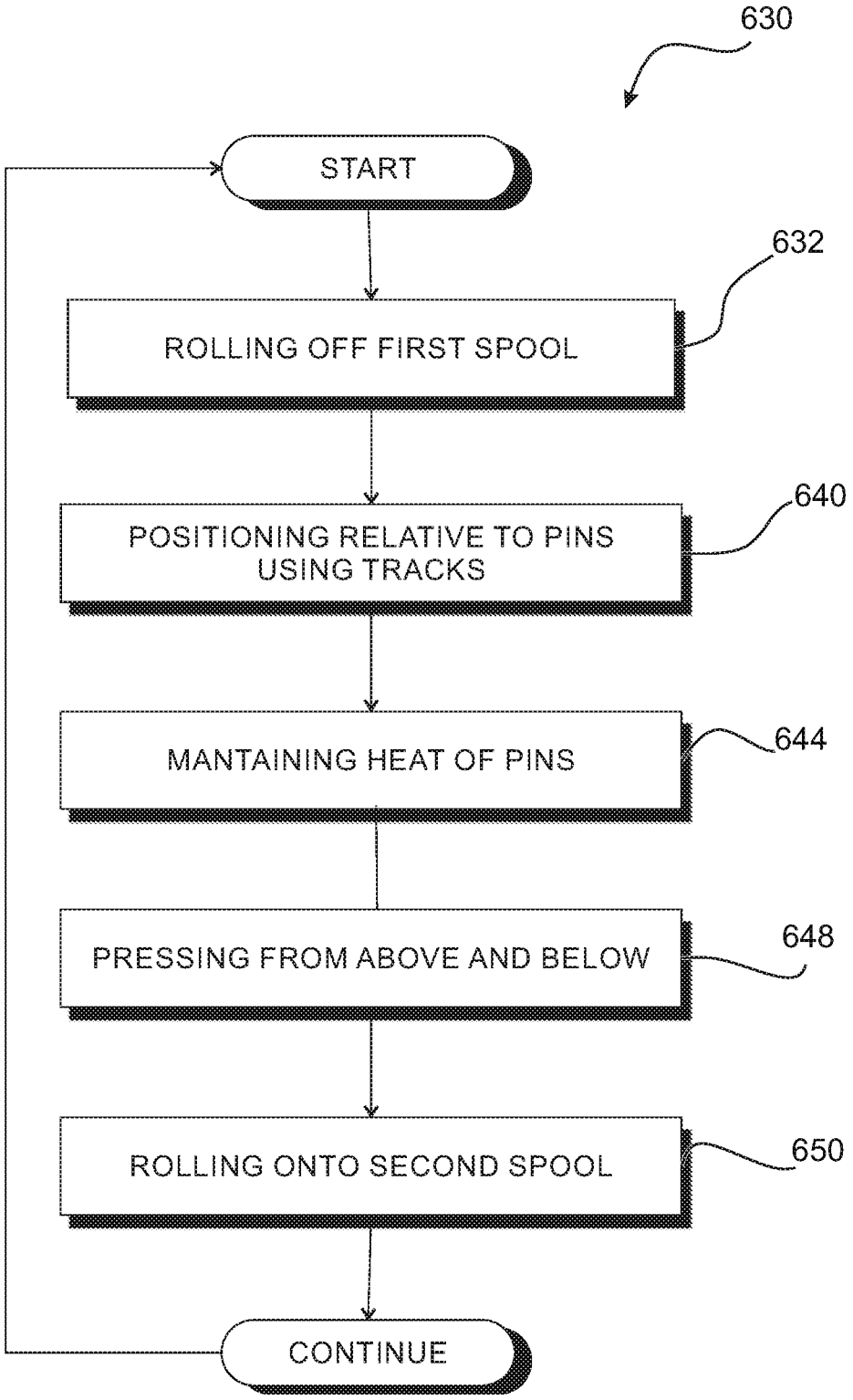
FIG. 19 illustrates the method of forming a pool cover arrangement, the method according to another preferred embodiment of the present invention.

Referring to FIG. 19, forming the inlets and outlets within the second set of cells 604 is achieved using a method 630 according to a further preferred embodiment of the present invention. At a block 632, the method 630 includes rolling a pool cover arrangement off a first spool. At a block 640 the method 634 includes positioning the pool cover arrangement. At a block 644 the method 634 includes maintaining the heat of a number of pins. At a block 648 the method 634 includes pressing the pins into a pool cover arrangement to provide offset pairs of inlets and outlets. At block 650 the method 634 includes rolling onto a second spool. The pressing of pins into the pool cover arrangement occurs concurrently from above and below. Following the pressing operation, the pool cover arrangement is concurrently rolled off the first spool and onto the second spool as occurs in spooling operations Referring to FIGS. 20 and 21 there is shown a pool cover press arrangement 656 according to a further preferred embodiment of the present invention. The press arrangement 656 is provided for use in manufacturing pool covers according to the method 630. In the press arrangement 656 there are provided two opposite press sections 657 each having sets of the pins 646. The press sections 656 are provided for receiving a pool cover arrangement 658 therebetween. An actuator 660 is provided for moving the pins 646 into the pool cover arrangement 658 to form openings in cells of the pool cover arrangement 646. A heating element 662 is provided for heating the pins 646.

Figure 20:
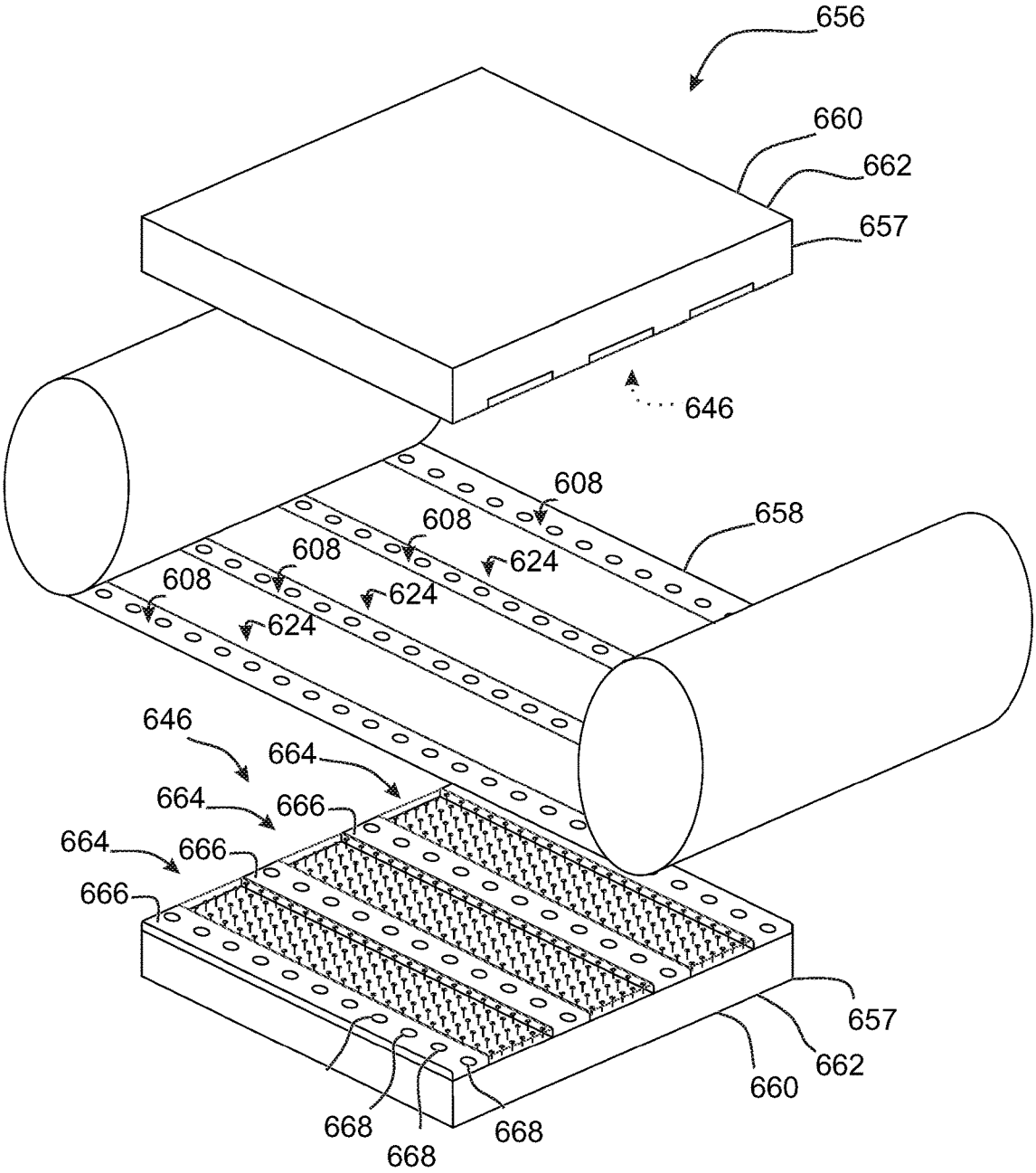
FIG. 20 illustrates a press according to an embodiment which is used to provide the method of forming a pool cover arrangement shown in FIG. 19, the press viewed from below.
Figure 21:
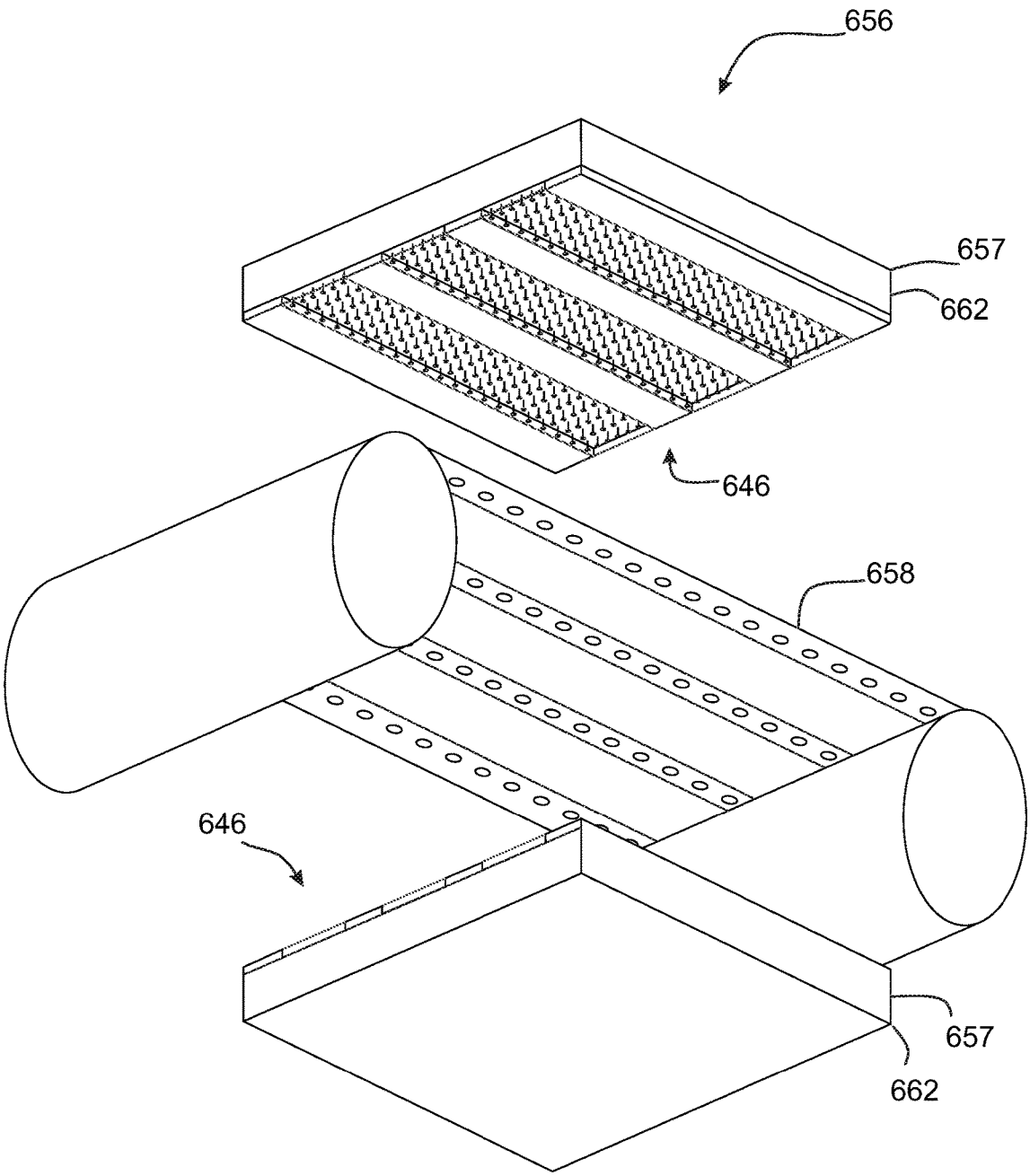
FIG. 21 illustrates the press shown in FIG. 20, the press viewed from above.

As shown in FIGS. 20 and 21, each press section pool cover arrangement 658 includes groups 664 of pins 646. In the lower press section the group 664 are separated by track arrangements 666 for receiving the lengths of a pool cover arrangement 658 containing location cells. The track arraignments 666 provide location elements 668 in the form of depressions (location elements) for receiving the location cells of the pool cover arrangement 658. The track arrangements 666 serve to hold the pool cover arrangement in position for pressing and are moveable to move the pool cover arrangements 654 after pressing to repeat the process. Each track arrangement 666 comprises a movable loop that is able to urge the pool cover arrangement along the press arrangement 6566 to provide a new section of the pool cover arrangement 658 for pressing.

At block 644, the method 630 includes heating the pins 646 to a temperature sufficient to heat the upper and lower layers at the points at which the pins are inserted through the upper and lower layers of the pool cover arrangement. The pins extend into the body, only a portion of the thickness of the pool cover length arrangement to create ventilation passages therein, the method at block 648 including pressing the pins into an upper layer and a lower layer of the pool cover arrangement. The temperature of the pins is maintained at a temperature say between 50 to 100 degrees Celsius to ensure that the material moves away from the pin and provides a ventilation hole.

In this embodiment the method 630 at blocks 648 and 650 includes pressing the pins into the upper layer and the lower layer concurrently, using a press, removing the pins and subsequently moving the pool cover arrangement to another position to repeat the pressing/hole formation operations.

By moving the track arrangements 666 the method 630 includes positioning location elements of the pool cover arrangement (the cells) in location elements (the depressions) provided by the press and moving the location elements of the press to move the pool cover arrangement after a pressing operation. The track arrangements 666 are each provided as a continuous looping track that is mechanically moved to position the pool cover arrangement. The looping tracks advantageously maintain the position of the pins relative to the pool cover arrangement by using cells formed in the pool cover arrangement. In this embodiment the location elements of the press comprise depressions sized to receive the location elements of the pool cover arrangement. The location elements of the pool cover arrangement comprise cells of the pool cover arrangement.

The applicant is presently developing a prototype machine along the lines described above. The machine provides for the formation of vented pool cover film from non-vented pool cover film. Among other things machine includes the following features: 1) Working web width of 1280 mm; 2) Film gauge of 250 um LPDE per layer (2 layers total); 3) Off-wind station to hold the roll of in-fed bubble film; 4) Maximum in-fed roll diameter of 2000 mm; 5) Top and bottom vent hole formation system. This comprises of automatically actuated top and bottom vent hole formation platens which precisely penetrate the relative bubble surfaces in order to form the required hole patterns. 6) Servo based film indexing system, utilizing 4 bubble-based guide strips which are evenly distributed across the web, thereby facilitating precise lateral and longitudinal bubble position control. This system cyclically indexes forward the bubble film in precise measures so as to present to the hole formation system the film as required; 7) Single station rewind station for use with industry standard 3" cores. This system rewinds the processed film into finished rolls; 8) Maximum rewound roll diameter of 700 mm; 9) Rewind tension control system to control rewound roll tension; 10) Machine start alarm to warn nearby personnel; 11) Emergency stop system which instantly cuts power to the machine; 12) Safety guarding of machine; 13) Solid state switching exclusively used (except for power contactors); 14) Timing belts or direct drives utilized in lieu of chains; 15) Fault diagnostic system; 16) Instruction manual; 17) Wire number identification; and 18) Wiring diagrams Various forms of location elements may be used including cells and extensions or depressions. In the described embodiment it is preferred that the location elements of the pool cover arrangement comprise cells thereof that engage with receptacles in the tracks, with the press sections holding the cells therein.

As would be apparent, various alterations and equivalent forms may be provided without departing from the spirit and scope of the present invention. This includes modifications within the scope of the appended claims along with all modifications, alternative constructions and equivalents.

There is no intention to limit the present invention to the specific embodiments shown in the drawings. The present invention is to be construed beneficially to the applicant and the invention given its full scope.

In the present specification, the presence of particular features does not preclude the existence of further features. The words 'comprising', 'including' and 'having' are to be construed in an inclusive rather than an exclusive sense.

It is to be recognised that any discussion in the present specification is intended to explain the context of the present invention. It is not to be taken as an admission that the material discussed formed part of the prior art base or relevant general knowledge in any particular country or region.

The claims defining the invention are as follows:

1. A pool cover arrangement comprising: a body configured to be positioned on a surface of a body of water; a number of cells provided by the body of the pool cover arrangement; and a number of ventilation passages extending through the body of the pool cover arrangement, wherein each ventilation passage of the number of ventilation passages has an inlet and an outlet for allowing chlorine gas to vent from the water, the inlet and the outlet of each ventilation passage being offset with respect to vertical when the body of the pool cover arrangement is positioned on the body of water to limit direct water exposure to sunlight during the middle of the day.

2. The pool cover arrangement of claim 1, wherein for each ventilation passage of the number of ventilation passages, the inlet has an opening area at least half the size of an opening area of the outlet.

3. The pool cover arrangement of claim 1, wherein the body of the pool cover arrangement comprises a first set of cells and a second set of cells, and the number of ventilation passages is provided in the second set of cells.

4. The pool cover arrangement of claim 3, wherein each of the cells in the first set of cells is a closed air-cell, and wherein each of the cells in the second set of the cells is an open air-cell that provides at least one ventilation passage of the at least one ventilation passage having an inlet and an outlet for allowing chlorine gas to vent from the water when the body of the pool cover arrangement is positioned on the body of water.

5. The pool cover arrangement of claim 4, wherein each open air-cell provides a cell area between each inlet and outlet that provides insulation with the open air-cell being disposed above the water surface when the body of the pool cover arrangement is positioned on the body of water.

6. The pool cover arrangement of claim 4, wherein each of the cells in the second set of the cells has a downwardly directed lower wall for directing water downwardly through a ventilation passage of the number of ventilation passages to limit the likelihood of water accumulation within the ventilation passage.

7. The pool cover arrangement of claim 6, wherein for each of the cells in the second set of cells, the downwardly directed lower wall provides a gradient of about 10 degrees.

8. The pool cover arrangement of claim 3, wherein the first set of cells provide a first area for floating on water; and the second set of cells is spaced away from the first area to allow the second set of cells to sit above the water, when the first set of cells sits on the body of water.

9. The pool cover arrangement of claim 3, wherein the second set of cells are spaced a distance of at least 1.5 mm from the surface of the body of water when the body of the pool cover arrangement is positioned on the water.

10. The pool cover arrangement of claim 3, wherein for each ventilation passage of the number of ventilation passages, the inlet has an opening area at least the size of an opening area of the outlet.

11. The pool cover arrangement of claim 3, wherein the second set of cells comprise elongate cells each having a respective inlet and outlet at opposite ends of the elongate cell, and the second set of cells being arranged at 90 degrees relative to the first set of cells.

12. The pool cover arrangement of claim 1, wherein the inlet of each ventilation passage of the number of ventilation passages is horizontally offset from the outlet of the ventilation passage by at least 3 mm when the body of the pool cover arrangement is positioned on the body of water.

13. A pool cover arrangement, comprising: a body having a first set of cells and a second set of cells; the second set of cells including bottom faces configured to at least partially sit above the surface of a body of water, each of the cells in the second set of cells having a ventilation passage providing an inlet and an outlet for allowing chlorine gas to vent from the water; the inlet and the outlet of each ventilation passage being horizontally offset with respect to vertical when the body is positioned on the body of water, the inlet and the outlet of each ventilation passage being offset to limit direct water exposure to sunlight during the middle of the day.

14. The pool cover arrangement of claim 13, wherein the inlet of each ventilation passage is horizontally offset from the outlet of the ventilation passage by at least 3 mm when the body is positioned on the body of water.

15. The pool cover arrangement of claim 13, wherein the inlet of each ventilation passage has an opening area at least half the size of an opening area of the outlet of the ventilation passage.

16. A method of forming a pool cover arrangement according to claim 13, the method comprising:

providing a first sheet of plastics material;

providing a second sheet of plastics material; and fixing the first sheet to the second sheet and forming a number of cells that includes the first set of cells and the second set of cells;

wherein the forming provides the second set of cells with the bottom faces, and with the ventilation passage in each cell of the second set of cells.

17. A method of forming a pool cover arrangement configured to be positioned on a surface of a body of water, the method comprising:

providing a first sheet of plastics material;

providing a second sheet of plastics material; and fixing the first sheet to the second sheet and forming a number of cells;

wherein said forming provides a first set of cells and a second set of cells; the first set of cells for providing heat insulation; the first set of cells provided for contacting the body of water; the second set of cells being inset relative to the first set of cells; each of the second set of cells providing a ventilation passage having an inlet and an outlet for allowing chlorine gas to vent from the water; the inlet and the outlet of each ventilation passage being horizontally offset when the body of the pool cover arrangement is positioned on the body of water, the offset between the inlet and the outlet of each ventilation passage being serving to limit direct water exposure to sunlight during the middle of the day.

18. The method of claim 17, wherein the inlet and outlet of each ventilation passage are horizontally offset by at least 3 mm when the body is positioned on the body of water.

19. The method of claim 17, wherein the second set of cells are inset by being of a reduced depth, relative to the first set of cells; the depth of each of the second set of cells being at least 1.5 mm; and the depth of each of the first set of cells being at least 3 mm.

* * * * *